US005983588A

United States Patent [19]

Haddock

[11] Patent Number: 5,983,588

[45] **Date of Patent: *Nov. 16, 1999**

[54] MOUNTING DEVICE FOR BUILDING SURFACES

[76] Inventor: Robert M. M. Haddock, 8655 Table Butte Rd., Colorado Springs, Colo. 80908

[ * ] Notice: This patent is subject to a terminal disclaimer.

[21] Appl. No.: 08/987,368

[22] Filed: Dec. 9, 1997

Related U.S. Application Data

[63] Continuation of application No. 08/482,274, Jun. 7, 1995, Pat. No. 5,715,640, which is a continuation-in-part of application No. 08/091,176, Jul. 13, 1993, Pat. No. 5,483,772, which is a continuation-in-part of application No. 07/912,845, Jul. 13, 1992, Pat. No. 5,228,248.

[51] Int. Cl.[6] ..... E04D 13/10

[52] U.S. Cl. ..... 52/545; 52/24; 52/25

[58] Field of Search ..... 52/24, 25, 545; 248/512, 535; 403/362, 388, 396

[56] References Cited

U.S. PATENT DOCUMENTS

| | | |
|---|---|---|
| 42,992 | 5/1864 | Howe . |
| 97,316 | 11/1869 | Rogers . |
| 106,580 | 8/1870 | Hathorn . |
| 189,431 | 4/1877 | Creighton . |
| 250,580 | 12/1881 | Rogers . |
| D. 351,989 | 11/1994 | Cline et al. . |
| D. 364,338 | 11/1995 | Cline . |
| D. 372,421 | 8/1996 | Cline . |
| 459,876 | 9/1891 | Powers . |
| 472,014 | 3/1892 | Densmore . |
| 473,512 | 4/1892 | Laird . |
| 529,774 | 11/1894 | Baird . |
| 602,983 | 4/1898 | Folsom . |
| 756,884 | 4/1904 | Parry . |
| 939,516 | 11/1909 | Laird . |
| 1,054,091 | 2/1913 | Darnall . |
| 1,085,474 | 1/1914 | Peterson . |
| 1,230,363 | 6/1917 | Baird . |
| 1,330,309 | 2/1920 | Dixon . |
| 2,079,768 | 5/1937 | Levow . |
| 2,201,320 | 5/1940 | Place ..... 52/25 |

(List continued on next page.)

FOREIGN PATENT DOCUMENTS

| | | |
|---|---|---|
| 13076 | 4/1903 | Austria . |
| 26329 | 6/1906 | Austria . |
| 298762 | 4/1972 | Austria . |
| 1215468 | 4/1960 | France . |
| 2 515 236 | 4/1982 | France . |
| 2 638 772 | 1/1990 | France . |
| 25 23 087 | 11/1976 | Germany . |
| 25 56 095 | 6/1977 | Germany . |
| 3617225 A1 | 11/1987 | Germany . |
| 37 23 020 A1 | 1/1989 | Germany . |
| 37 28 831 A1 | 1/1989 | Germany . |
| 91 12 788 U | 12/1991 | Germany . |
| 204783 | 5/1939 | Switzerland . |
| 388 590 | 6/1965 | Switzerland . |
| 469159 | 4/1969 | Switzerland . |
| 671063 A5 | 7/1989 | Switzerland . |

OTHER PUBLICATIONS

Thycurb Catalog, Snow Dam, (unknown publication date).

*Primary Examiner*—Christopher T. Kent
*Attorney, Agent, or Firm*—Sheridan Ross P.C.

[57] ABSTRACT

A clamp for controlling uplift on a metal roof. The clamp includes a unitary mounting body having a slot extending therethrough. This slot may be positioned over/about a standing seam on a metal roof and be appropriately secured thereto, such as by the use of blunt-nosed screws which engage the seam material.

54 Claims, 22 Drawing Sheets

OTHER PUBLICATIONS

| | | | |
|---|---|---|---|
| 2,448,752 | 9/1948 | Wagner . | |
| 4,141,182 | 2/1979 | McMullen . | |
| 4,593,877 | 6/1986 | Van Der Wyk . | |
| 5,152,107 | 10/1992 | Strickert . | |
| 5,222,340 | 6/1993 | Bellem . | |
| 5,224,427 | 7/1993 | Riches et al. . | |
| 5,228,248 | 7/1993 | Haddock | 52/25 |
| 5,271,194 | 12/1993 | Drew | 52/25 |
| 5,282,340 | 2/1994 | Cline et al. . | |
| 5,483,772 | 1/1996 | Haddock . | |
| 5,491,931 | 2/1996 | Haddock . | |
| 5,522,185 | 6/1996 | Cline . | |
| 5,609,326 | 3/1997 | Stearns et al. | 52/25 X |
| 5,613,328 | 3/1997 | Alley | 52/24 X |
| 5,647,178 | 7/1997 | Cline . | |
| 5,694,721 | 12/1997 | Haddock . | |
| 5,715,640 | 2/1998 | Haddock . | |

MOUNTING DEVICE FOR BUILDING SURFACES

RELATED APPLICATION

This patent application is a continuation of U.S. patent application Ser. No. 08/482,274, filed Jun. 7, 1995, now U.S. Pat. No. 5,715,640, issued Feb. 10, 1998, which is a continuation-in-part of U.S. patent application Ser. No. 08/091,176, filed Jul. 13, 1993, now U.S. Pat. No. 5,483,772, issued Jan. 16, 1996, which is a continuation-in-part of U.S. patent application Ser. No. 07/912,845, filed Jul. 13, 1992, now U.S. Pat. No. 5,228,248, issued Jul. 20, 1993. The entire disclosure of each of the above-identified applications is incorporated by reference herein.

FIELD OF THE INVENTION

The present invention generally relates to an apparatus and associated method for controlling uplift of a metal roof and, more specifically, to a unitary mounting device positionable and securable to part of a raised portion or seam of a roof.

BACKGROUND OF THE INVENTION

Metal roofs formed by interconnected metal panels can be susceptible to uplift and tearing due to lifting forces caused thereon by blowing winds. Such wind blown metal panels can be hazardous to nearby people and property. For example, during particularly windy conditions, metal panels can detach or tear from the metal roof and injure passers-by. As such, and with the increased use of metal panels in building construction, there has been an increased need to address ways in which to simply and conveniently control the uplift of such metal roofs.

U.S. Pat. No. 5,222,340 to Bellem, issued Jun. 29, 1993, generally discloses a device for increasing uplift resistance of metal standing seam roofs. The device disclosed in Bellem includes a first elongate part having a head, a longitudinal recess beneath the head, a foot extending below the recess and a hole laterally extending therethrough, a second elongate part having a hole laterally extending therethrough and a mating surface opposing the recess and mating surface of the first elongate part, and a fastener for drawing the first and second elongate parts together, to confine the roof seam in the recess. The device disclosed in Bellem however, is not readily adaptable to certain raised seams, especially horizontal standing seams (i.e., seams that are oriented parallel to the roofing surface or a raised seam on a metal roof that protrudes primarily laterally in relation to the roof). In addition, securing the device of Bellem to raised portions on a roof is time consuming as the first and second elongate parts must both be positioned about the raised seam such that the holes extending laterally through the first and second elongate parts are aligned. Once aligned, a fastening device may be inserted through the holes in order to draw the first and second elongate mating parts together to confine the raised portion within the recess of the first elongate part. In this regard, the assembling of a number of the devices of Bellem on a metal roof is a time and labor intensive task, which results in increased costs.

There has also been an increased need to address ways in which various building attachments can be interconnected with a metal panel surface. For instance, there is often a need to attach a sign to the face of a metal panel. Moreover, in the case of metal roofs, there is often a need to mount/secure various types of equipment thereon (e.g., fans, air conditioning units, walkways, signage, facades) via an appropriate frame. In addition, in various climates it may be desirable to position a snow retention device on a metal roof to control/inhibit/impede the movement of snow and/or ice down the pitch of the roof.

Sliding snow and/or ice from roofs can be hazardous to people, the surrounding landscape, property, and building components. For example, snow or ice sliding from a roof above an entryway may injure passers-by. Similarly, falling snow or ice can do damage to landscape features, such as shrubs, and property or building components, including automobiles or lower roofing portions. In addition, sliding snow or ice can shear off antennas, gutters or other components attached to a building roof or wall, thereby potentially causing a leak. The problem of sliding snow or ice is particularly experienced in connection with metal roofs, including raised seam roofs (e.g., standing seam), where there is relatively little friction between the roof and the snow or ice. As used herein, the term "raised seam roofs" includes roofs formed by a series of panels interconnected to define longitudinal, raised portions. It may therefore be desirable to provide a guard suitable for controlling movement of snow and/or ice across/along selected areas of such metal roofs.

Snow guard devices were initially developed for use on tile and shingle roofs. In one type of configuration for use on such roofs, an L-shaped brace has one leg which is fastened to the roof and another leg which projects upwardly from the roof. The fastening leg is typically nailed or screwed into the roof beneath a shingle or tile. By positioning and attaching a plurality of these braces to the roof in substantially linear fashion, linear bars may be positioned within/through one or more receiving areas of the respective upwardly projecting legs to provide a fence-like configuration for snow and/or ice retention. U.S. Pat. Nos. 97,316 to Rogers, issued Nov. 30, 1869, 106,580 to Hathorn, issued Aug. 23, 1870, 250,580 to Rogers, issued Dec. 6, 1881, and 756,884 to Parry, issued Apr. 12, 1904, are generally representative of this type of device.

A device which employs a similar structure to the above but which does not require the individual braces to actually be affixed to the roof is presented in U.S. Pat. No. 42,972 to Howe, issued May 31, 1864. In this case, the plurality of braces for receiving the linear bars are positioned on opposite sides of the roof and are interconnected by a harness assembly. By positioning the brace/bar assemblies on both sides of the roof, the snow retention device is presumably held in position.

Other snow retention devices for shingle or tile roofs have utilized a more unitary structure. For instance, U.S. Pat. No. 459,876 to Powers, issued Sep. 22, 1891, discloses a snow guard having two laterally displaced spikes which are driven into the roofing surface, with the interconnecting portion of the spikes having a generally V-shaped configuration which extends downwardly toward the roofing surface. U.S. Pat. No. 602,983 to Folsom, issued Apr. 26, 1898, discloses a device used with a tiled roofing surface having grooves formed such that the spikes or leg portions of the device may be positioned therein. An interconnecting portion between the spikes or legs in this instance incorporates a loop-like configuration.

Another snow retention device is the SNOWJAX™ snow guard which is believed to be the subject of U.S. Pat. No. 4,141,182 to McMullen, issued Feb. 27, 1979. This device comprises a plastic barrier having a generally L-shaped cross-section. The device can be installed by smearing the underside of the device with silicon intended to provide a weather seal, positioning the device against the roof surface, and attaching the device to the roof with screws such that the screws penetrate the roofing surface and become anchored into an underlying structural member. An adhesive may be used in place of the screws where desired.

The ThyCurb division of Thybar Corporation has also marketed a snow guard device for use on trapezoidal-type, standing seam roofs having 24 inch wide panels and is believed to be the subject of U.S. Pat. No. 5,152,107 to Strickert, issued Oct. 6, 1992. The device comprises a horizontal steel member which spans one panel width. The horizontal member is fixedly attached at ends thereof to mounting members which straddle the trapezoidal panel ribs. These mounting members are fastened to the panel ribs by screws.

There are a number of problems generally associated with one or more of the snow guard devices described above. First, such devices may cause the roof to leak. Many of the devices described above are attached to the roof by a screw, nail or other fastener which pierces the roofing surface. Such piercing of the roof can lead to undesired leakage due to inadequate sealing or shearing of the fastener by the forces exerted thereon by sliding snow and/or ice. In an attempt to prevent leakage, sealants and/or gaskets are often applied around the holes pierced through the roofing surface. However, these measures complicate installation and may not fully prevent leaks. Alternative methods for the attachment of snow guard devices to roofs such as adhesive bonding may fail to provide secure attachment and/or may be difficult to install on a sloped surface, particularly where the device is applied to a smooth, non-porous roofing material such as metal.

Many known snow guard devices can also cause undesired pinning of the roofing materials. Metal roofing sheets are often designed to be moveable so as to accommodate normal thermal expansions and contractions. Where snow guard devices such as described above are attached to the roof by a screw, nail or the like which pierces the roofing surface and is anchored into an underlying structural member or deck, the designed thermal movement characteristics of the roof can be compromised, thereby adversely affecting the roof's performance.

The types of snow guard devices described above are also generally not readily adaptable for use in a broad range of raised seam roofing applications. Some of the devices described above are not intended for raised seam roofing applications at all but, rather, are primarily for use on shingled or other non-raised seam roofs. Other known devices are designed for use on raised seam roofs having a particular panel width and seam profile and cannot be easily adjusted for use in connection with panels of differing widths or seams of various profiles. Moreover, some known devices are designed to be permanently connected to a roof such that the device cannot be easily repositioned as may be desired. In addition, known snow guard devices generally comprise a snow blocking element having a height, relative to the roof surface, which is unadjustable, difficult to adjust, or adjustable only between a small range of predetermined positions. Accordingly, the user's ability to adjust such devices, as may be desired to suit particular conditions with respect to snowfall, drifting and the like, is limited.

Based upon the foregoing, there is a need for a clamp which is easy to use, adaptable to horizontally or vertically oriented raised seams, and positionable on a raised seam without adversely affecting its performance.

SUMMARY OF THE INVENTION

The present invention is generally directed toward a utility mounting device which is attachable to a raised portion or seam of/on a building surface, such as to facilitate an interconnection between a member (e.g., snow retention device, frame, sign) and the building surface. Typically, the present invention will be used with a metal roofing or siding surface which is formed by interconnected sheet metal panels which define a certain standing seam configuration at the panel interconnection and in which a base portion is thus positioned between the standing seams at a lower elevation (relative to the upper portion of the standing seam). Consequently, the present invention will be described with regard to such standing seams, although it will be appreciated that all that is required for use of the present invention is a raised portion on a building surface to allow for attachment of the mounting device of the present invention thereto.

In one aspect of the present invention, a mounting device is provided which includes a unitary mounting body, which may be formed from a substantially rigid material, for simplified attachment of the mounting device to the building surface. A slot is formed in and extends through at least a portion of the mounting body and is formed by at least two sidewalls. The slot also has a height, width and a length, the length exceeding at least one of the width and height. Moreover, the slot may be positioned over at least part of the standing seam. In this regard, a securing assembly is also provided for securing at least part of the raised portion within the slot. This securing assembly may include one, but preferably two or more threaded members which extend through the mounting body and one of the sidewalls of the slot to forcibly engage the standing seam between the member(s) and the opposing slot sidewall. Moreover, a cavity (e.g., hole, dimple) may be formed on the opposing sidewall of the slot such that part of the standing seam is deformed therein by the engagement of the threaded member against the opposing surface of the standing seam.

The above-described mounting body may also include a first mounting cavity which is adapted for receiving a member to be interconnected with the building surface (e.g., snow retention device, frame structure, sign) or more typically an interconnector/adapter between the member and mounting body. This mounting cavity is preferably on a surface of the mounting device which itself may be used to provide support (e.g., an upward facing surface). In some applications, it may be desirable to incorporate a second mounting cavity. For instance, in order to accommodate for the use of the mounting device with both vertical and horizontal standing seam configurations (i.e., the general orientation of the upper portion of the seam), it may be desirable for the first and second mounting cavities to assume different (e.g., generally perpendicular) orientations through the mounting body. In this case, a generally upwardly extending mounting cavity can be available for use regardless of the orientation of the mounting device on the standing seam.

Another aspect of the present invention is directed toward a roof assembly which utilizes a mounting device for a roofing surface having the above-described displaced standing seams. In this regard, one mounting device is appropriately secured to one of the laterally-displaced standing seams and another mounting device similarly secured to another of the standing seams. A first member extends between and is interconnected with these mounting devices to control the movement of snow and/or ice down the pitch of the roof along the panel base between the standing seams. In order to further assist in the control of this movement, a second member is attached to and extends away from the first member into engagement with the panel base. In order to allow for adaptation of the second member to a variety of applications (e.g., different roof pitches, where the spacing between the standing seams varies such that it may be desirable to use two or more of the second members between each pair of adjacent standing seams), the second member may be detachably connected to the first member by a snap-fit connector which includes an arcuate cavity and inwardly projecting detent. One orientation which the second member may assume is to extend from the first member in a direction which is generally toward the peak of the roof such that the snow and/or ice will effectively wedge the second member in position against the panel base of the roof.

Another aspect of the present invention is directed toward a roof assembly for a roofing surface having the above-described laterally-displaced standing seams. A first member extends between the displaced standing seams and includes at least one channel portion for receiving a second member. The first member is interconnected with the standing seams by mounting devices such as those described although other types of fasteners may be used. Although this first member may be used to control the movement of snow and/or ice down the roof, it may also be used to provide for color coordination between the roofing surface and the roofing assembly to improve/maintain aesthetics by selecting a second member of a desired color. That is, the second member may actually be cut to size from one of the sheet metal panels and positioned within the first member. In this regard, another member may extend between the mounting devices behind the first member (i.e., more towards the peak of the roof) to primarily provide for the control of movement of snow and/or ice down the pitch of the roof.

Another aspect of the present invention is directed to a mounting device (i.e., a clamp) for controlling the uplift of metal roofs. The present invention is particularly useful in connection with roofs which are formed by interconnected metal panels which define a standing or raised seam configuration at the interconnection between adjacent panels. In this aspect of the present invention and substantially as described above in connection with other embodiments of the invention, each clamp comprises a unitary mounting body and has a slot extending therethrough. The slot may be positioned over at least part of the standing seam to receive at least a portion of the seam within the slot. A securing assembly comprising an elongated member extends through at least one bore or hole in the unitary mounting body to engage (e.g., frictionally) and secure at least a portion of the seam within the slot of the unitary mounting body. The one-piece mounting body facilitates installation, and allows for use with multiple standing seam configurations and/or orientations.

In another embodiment of the invention, the clamp may further comprise at least one leg extending from the unitary mounting body. The leg functions to provide additional surface area to engage the standing seam and/or panels, which provides for increased control against uplift of the roof. The legs may be integrally formed with the unitary mounting body and may extend from a lower surface of the unitary mounting body. The legs may extend generally laterally relative to a side surface of the unitary mounting body or, alternatively, be disposed at an obtuse angle relative to a side surface of the unitary mounting body, depending upon whether the standing seam is straight (e.g., horizontally oriented) or trapezoidal in configuration.

Another aspect of the present invention directed to controlling uplift on roof includes utilizing the above-described clamps with cross-members extending therebetween. Such cross-members primarily function to provide resistance against bowing of portions of the panels (i.e., the base of the panels) between the seams. Cross-members may extend above the roof between adjacent panels and, in a preferred embodiment, are connected to clamps mounted on the seams where clips extend between the seams and a roof substructure. In a preferred embodiment, the cross-members are connected to the clamps such that the cross-member engages or is positioned above the base of the panels.

The above-described clamps may be positioned at various locations on a roof. In a preferred embodiment, a plurality of clamps can be positioned at predetermined locations corresponding with areas in which the seams are interconnected or "anchored" to a roof substructure, such as a purlin. In this regard, the unitary mounting bodies may be positioned and secured to portions of seams having a part of a clip therebetween, the clip extending between and interconnecting a raised seam and a purlin.

BRIEF DESCRIPTION OF THE DRAWINGS

For a more complete understanding of the present invention and further advantages thereof, reference is now made to the following Detailed Description taken in conjunction with the Drawings, in which.

DETAILED DESCRIPTION

The present invention will be described with reference to the accompanying drawings which assist in illustrating the pertinent features thereof. In this regard, the present invention is generally a mounting device which may be positioned upon a building surface (e.g., roof, sidewall) in a desirable manner to provide for a variety of applications, one of which is to control the movement of snow and/or ice down/along a predetermined sloped portion of a roofing surface.

Figure 1:
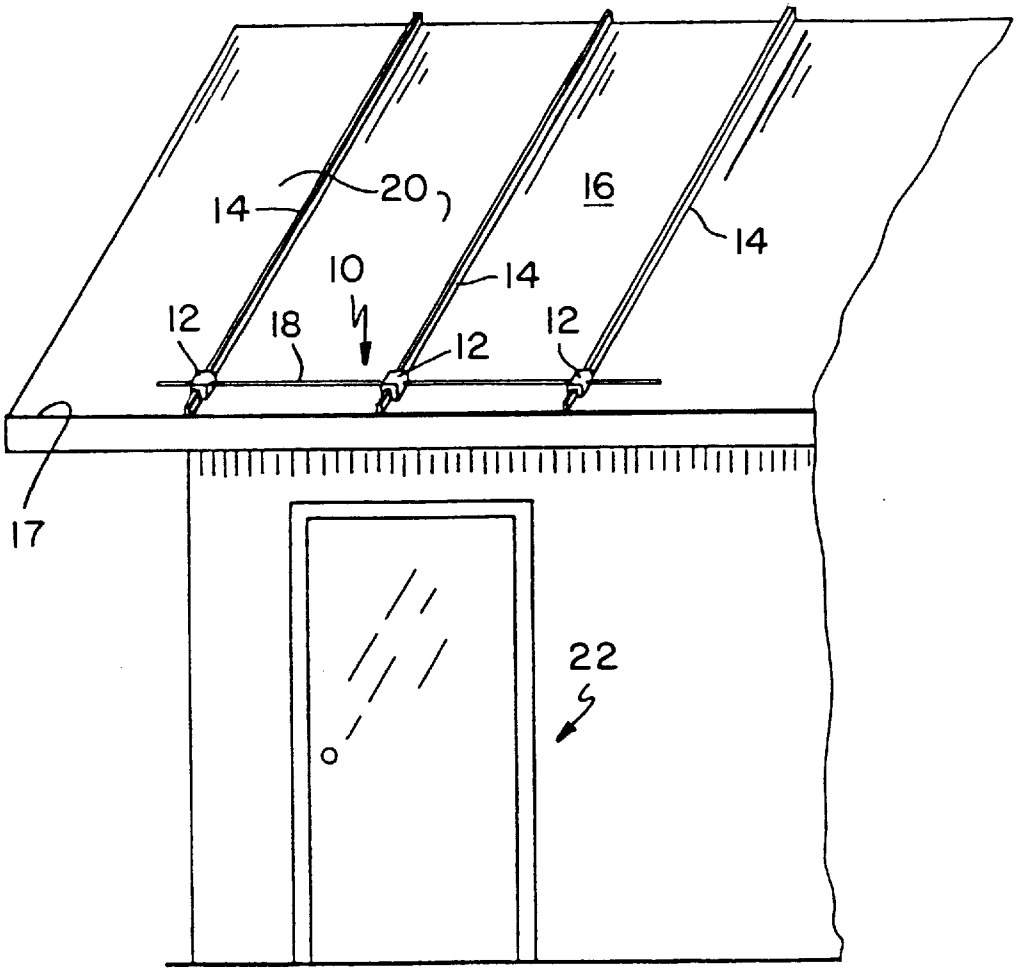
FIG. 1 is a perspective view of an assembly for one application of the present invention.
Figure 2A:
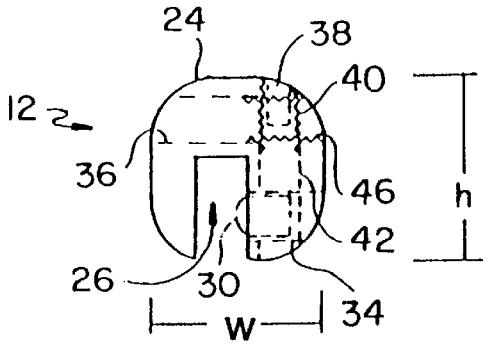
FIG. 2*a* is a front view of a mounting device constructed in accordance with one embodiment of the present invention.
Figure 2B:
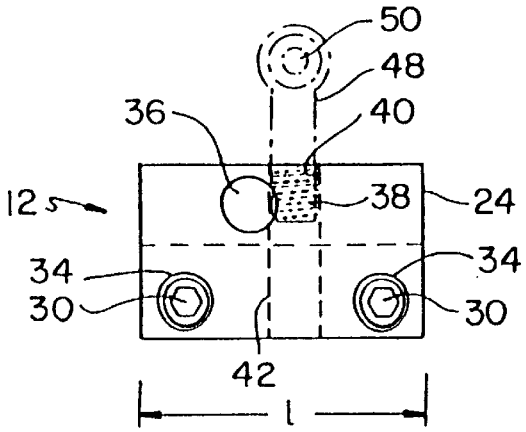
FIG. 2*b* is a right side view of the mounting device of FIG. 2*a;*
Figure 2C:
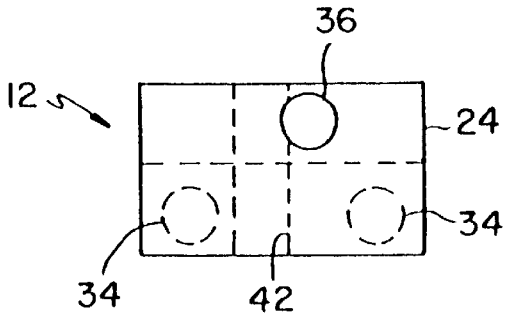
FIG. 2*c* is a left side view of the mounting device of FIG. 2*a;*
Figure 2D:
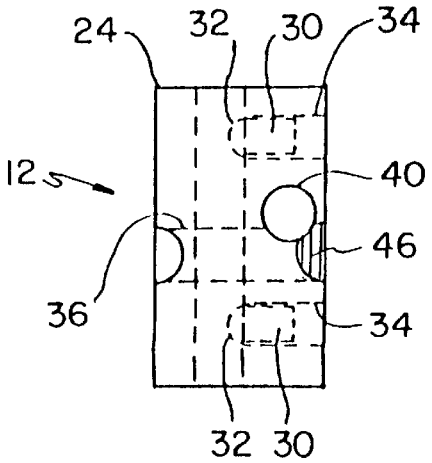
FIG. 2*d* is a top view of the mounting device of FIG. 2*a;*
Figure 2E:
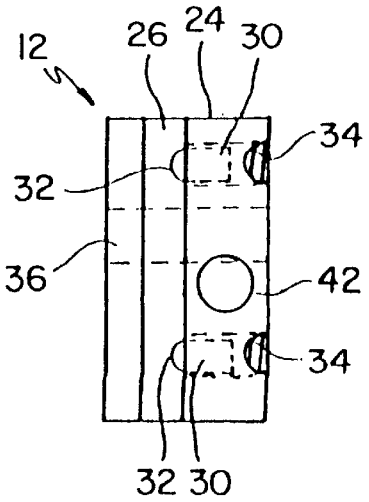
FIG. 2*e* is a bottom view of the mounting device of FIG. 2*a;*

Referring to FIG. 1, a roof assembly 10 utilizes a mounting device of the present invention. Generally, the roof assembly 10 includes at least two mounting devices 12 (three shown and described in more detail below) for attachment to ridges or standing seams 14 of a roof 16 and at least one cross-member 18 spanning between adjacent mounting devices 12. The cross-member 18 controls the movement of snow and/or ice along its respective underlying portion of the roof. More particularly, the movement of snow and/or ice positioned above and aligned with the cross-member 18 is controlled in that the movement of such snow or ice past the cross-member 18 toward the eaves 17 is retarded and/or terminated. As can be appreciated, this may be desirable in a number of circumstances, such as when a sloping portion of the roof 16 is positioned above an entryway 22.

One embodiment of the mounting device 12 which may be used with the roof assembly 10 of FIG. 1 is more particularly illustrated in FIGS. 2*a*–*e*. Initially, the body 24 of the mounting device 12 may be formed from materials such as various metals, ceramics or plastics based upon, for instance, the particular application. In this regard, the illustrated mounting device 12 is formed from aluminum which provides sufficient load-bearing capability and is also non-corrodible, thus enhancing durability and appearance. As can be appreciated, the aluminum can be anodized to further enhance the appearance of the roof assembly 10. Other metals for forming mounting device 12 are stainless, zinc, copper or brass alloys. The mounting device 12 may also be formed by a variety of methods, one of which is extrusion.

The body 24 of the mounting device 12 generally has a cross-section defined by a longitudinal slot 26 which receives the ridge 14 therein. The edges of the body 24 may be chamfered or rounded if desired to reduce material requirements and enhance the appearance of the roof assembly 10. Moreover, the dimensions of the mounting device 12 can be varied and may be selected to suit particular applications. For example, the depth, width, or shape of the slot 26 can be selected to closely match the profile of the ridges 14 and/or to accommodate for ridges 14 within a predefined range of widths. Furthermore, the body 24 of the mounting device 12 can be dimensioned to allow the cross-member 18 to be positioned a desired distance above the surface of the roof 16. In the illustrated application, the mounting device 12 has a width, w, of approximately 1¼ inches; a height, h, of approximately 1¼ inches; and a length, l, of about 2 inches. Moreover, the slot 26 is about ¾ inches deep (high) and ⅜ inches across (wide). These dimensions have been found suitable for an appropriate range of raised seam roofing applications. In order to provide for a desired degree of stability of the mounting device 12 when attached to a raised portion 14, the length of the slot 26 (which in the illustrated embodiment is equal to the length of the mounting device 12) should exceed at least one of the height of the slot 26 and the width of the slot 26, the length of the mounting device 12 should be at least about 1½ inches, and/or multiple fasteners (screws 30 with non-piercing ends 32 discussed below) should be used.

It is an advantage of the present invention that the mounting device 12 can be attached to the roof 16 in a manner such that the roof 16 is not pierced. In this regard, the mounting device 12 can be secured to the roof 16 by frictionally engaging external surfaces of the ridge 14 rather than by using a screw, nail or the like which penetrates through the roofing material. For example, this frictional engagement can be accomplished by friction fitting the slot 26 to the ridge 14 and/or by extending at least one protrusion from a wall of the slot 26, after the body 24 has been positioned on the ridge 14, such that the protrusion frictionally engages the ridge 14. In the illustrated embodiment, a pair of set screws 30 are threadably extendible from a wall of the slot 26 and are utilized to engage the ridge 14. The illustrated screws 30, which can have blunt or rounded non-piercing ends 32, frictionally engage the ridge 14, such as by dimpling without penetrating the same. Moreover, the screws 30 force the ridge 14 against the opposing sidewall of the slot 26. Access to the screws 30 is provided through threaded bores 34. Conveniently, the screws 30 can be provided with an allen head dimensioned so that the screw can be hidden within body 24 and yet can be easily adjusted. Based upon this manner of installation, it will be appreciated that the mounting device 12 can be easily repositioned on the ridge 14 as may be desired without leaving holes in the ridge 14 which could cause leakage.

Although two screws 30 are illustrated with regard to mounting device 12 to engage the seam 14 at two displaced locations, it will be appreciated that the actual number used may depend upon a number of factors. For instance, the length, l, of the mounting device 12 may dictate the maximum number of screws 30 which may be employed. However, in order to provide for a secure engagement of the device 12 on the seam 14, preferably two or more screws 30 are used for each device 12.

Figure 3A:
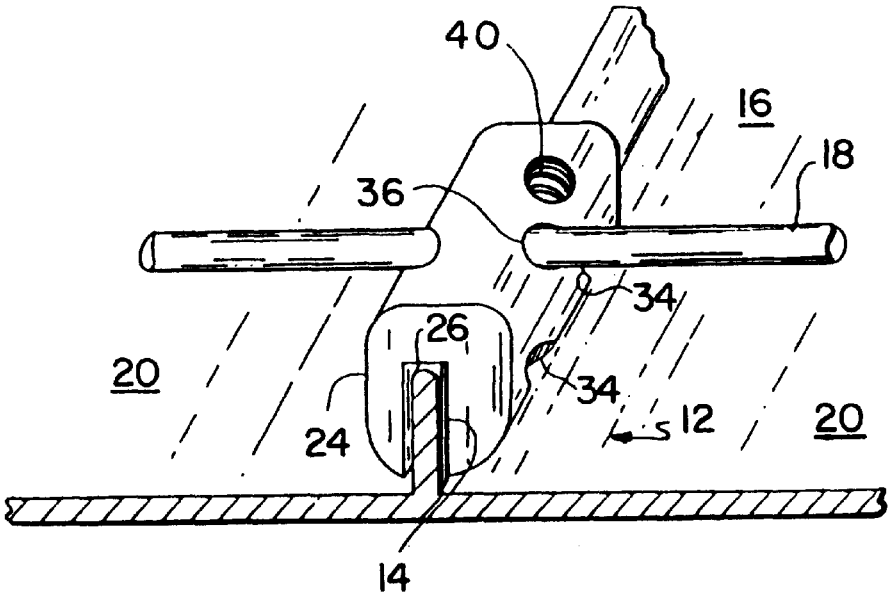
FIG. 3*a* shows the assembly of FIG. 1 installed in a generally vertical configuration.
Figure 3B:
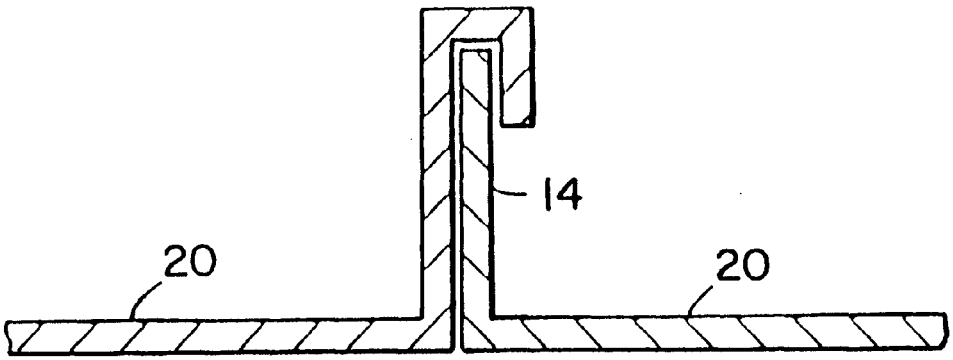
FIG. 3*b* shows a particular raised seam profile on which the assembly of FIG. 1 may be installed in a generally vertical configuration.

Any suitable means may be utilized for interconnecting mounting device 12 and cross-member 18. The illustrated mounting device 12 is provided with openings 36, 42 dimensioned so as to be capable of slidably receiving the cross-member 18 therein when in different positions upon the ridge 14. Moreover, these openings 36, 42 extend through a substantially planar surface of the body 24 of the mounting device 12 which may be used as a supporting surface in certain applications (e.g., when a frame is attached to the mounting device 12, as will be discussed below). With regard to the multiple positionings and as illustrated in FIG. 3*a,* in one particular type of standing seam configuration (only generally illustrated) to define the ridge 14 the cavity 26 of the mounting device 12 extends in a generally downward direction. A common raised seam profile of this type is illustrated in FIG. 3*b*. The cross-member 18 and mounting device 12 can thus be interconnected by sliding the cross-member 18 through the opening 36 (which extends from one side surface of the body 24 to the other side surface above the slot 26 and typically in a direction which would be substantially perpendicular to a plane containing a sidewall of the slot 26) and securing the cross-member 18 to the mounting device 12 with a set screw 38 or the like. The set screw 38 is threaded into a threaded bore 40 which intersects the opening 36 such that the screw 38 contacts the cross-member 18 so as to secure the positioning of the cross-member 18 in the mounting device 12. If desired, an eye bolt 48, shown in phantom in FIG. 2*b,* may be provided in place of the set screw 38, to allow an additional cross-member 50 (phantom) to be provided higher above the panels 20 in a similar orientation to the cross-member 18. Alternatively, only the cross-member 50 need be utilized and such may be positioned through the eye bolt 48. In this case, it can be appreciated that by varying the length of the eye bolt 48, the distance between the panels 20 and the cross-member 50 may be adjusted which may be desirable under certain circumstances. As an alternative to using the eye bolt 48, a cross-member (not shown) of a desired configuration may be directly attached to the upper surface of the mounting device 12 in a suitable manner (e.g., via appropriate threaded connections within the body 24), such as in the case of the cross-members 82', 82" illustrated in use with the roof assembly 52 of FIGS. 5*b* and/or 5*c*.

Figure 4A:
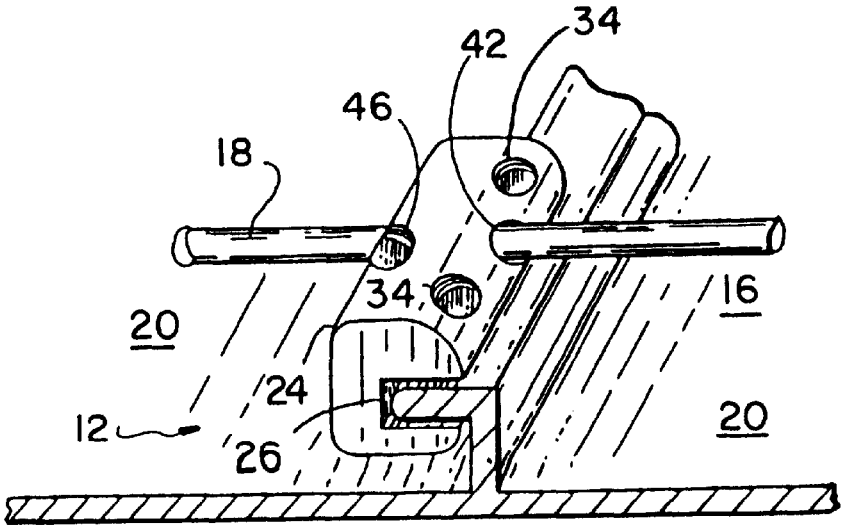
FIG. 4*a* shows the assembly of FIG. 1 installed in a generally horizontal configuration.
Figure 4B:
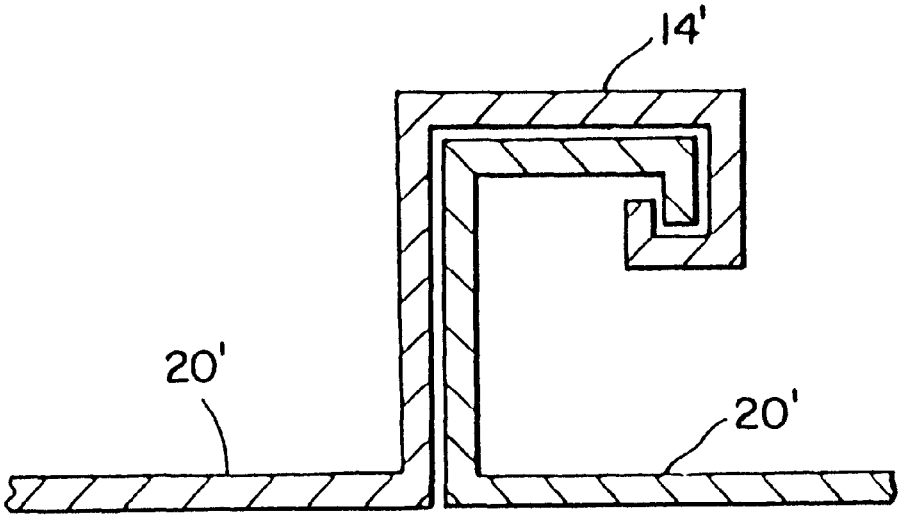
FIG. 4*b* shows a particular raised seam profile on which the assembly of FIG. 1 may be installed in a generally horizontal configuration.

The mounting device 12 may also assume the orientation illustrated in FIG. 4*a* in which the cavity 26 projects in a substantially parallel direction to that of the panels 20. This is utilized in conjunction with another particular type of standing seam configuration 14' which is only generally illustrated in FIG. 4*a*. A common raised seam profile of this type is illustrated in FIG. 4*b*. In this instance, the cross-member 18 is received within the opening 42 (which extends from an upper surface of the body 24 to its lower surface at a location between the slot 26 and a side surface of the body 24, and typically in a direction which is generally parallel with the sidewall of the slot 26) and may be retained therein by a set screw (not shown) positioned within an end portion of the bore 46. It should be noted that bore 40 forms a portion of opening 42. Similarly, bore 46 forms a portion of opening 36. Thus, bore 40/opening 42 and bore 46/opening 36 can be partially threaded as shown. The above-described eye bolt 48 may also be positioned within the bore 46 as in the case of the above-described vertical orientation of the mounting device 12 noted above to provide for the discussed alternatives (not shown).

Based upon the foregoing, it will be appreciated that a primary function of the openings 36 and 42 is to accommodate multiple orientations of the device 12 on a seam 14. Therefore, in providing this function the openings 36, 42 may be spaced on the body 24 instead of being partially intersecting. In this case, a separate set screw cavity (not shown) may be bored through the body 24 of the mounting device 12 to intersect with one of the openings 36, 42 (e.g., by being substantially perpendicular thereto) such that a conventional set screw (not shown) may be used to secure the cross-member 18 to the device 12.

The cross-member 18 can be formed from any suitable material including various metals, ceramics or plastics. The illustrated cross-member 18 is a solid rod formed from aluminum which can be anodized if desired. Other metals may be stainless, zinc, copper or brass alloys. Although various cross-member 18 thickness/diameter may be utilized in accordance with the present invention, the illustrated member has a diameter of about ⅜ inches. Accordingly, bore 40/opening 42 and bore 46/opening 36 can have diameters of about ⅜ inches or slightly more than ⅜ inches so that the cross-member 18 can be slidably received therethrough. The length of the cross-member 18 can be selected, for example, based on the width of the panels, the width of the area across which snow or ice slide protection is desired, or other factors (e.g., a single cross-member 18 may extend through a plurality of mounting device 12, or an individual cross-member 18 may extend only between two mounting devices 12). In this regard, it is an advantage of the present invention that the roof assembly 10 is easily adaptable for use in connection with a variety of roofing applications involving panels of various widths. The cross-member 18 can be received within the body 24 of the mounting devices 12 in the described manner, can be generally straight as shown in FIGS. 3*a* and 4*a,* or can be bent as described below in connection with a further embodiment of the invention so as to allow adjustment of the height of the cross-member 18 over the roof 16. Moreover, a cross-member (not shown) for use alone or in combination with the cross-member 18 may be provided and may be secured to the mounting device 12 by utilizing the threaded bored openings 36/46 or 42/40, or alternatively by field drilling and/or tapping additional holes in the mounting device 12. This cross-member may consist of a variety of geometries other than the rod of the cross-member 18, such as the "L" and "Z" shaped configurations illustrated in FIGS. 5*b* and 5*c* for cross-members 82' and 82", respectively.

Figure 5A:
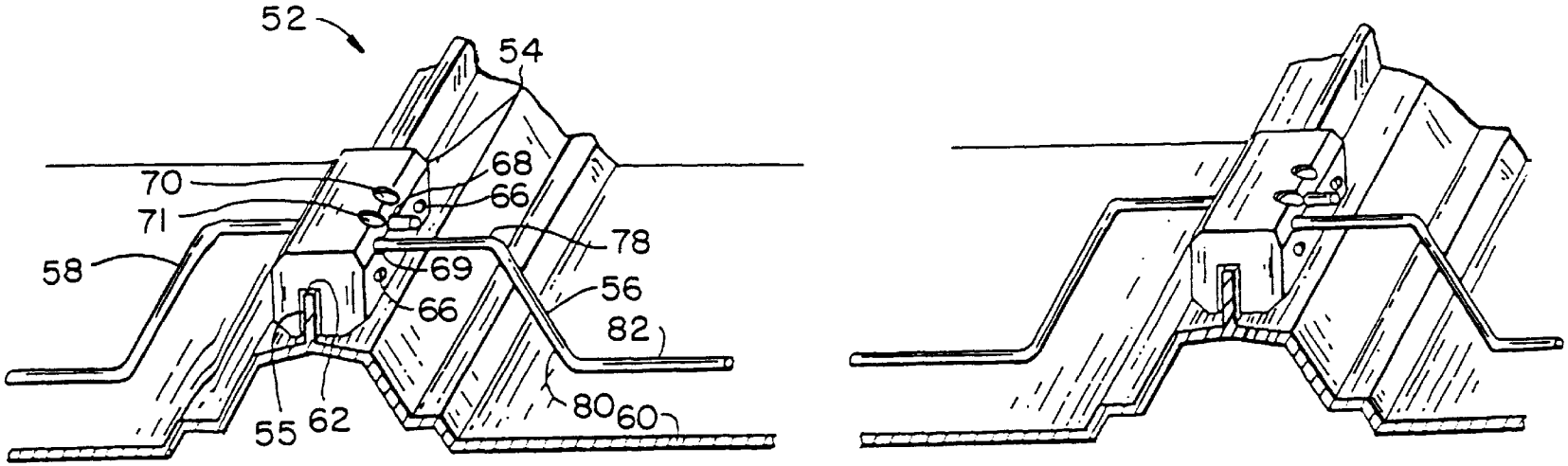
FIG. 5*a* is a perspective view of an assembly for one application of the present invention.
Figure 5B:
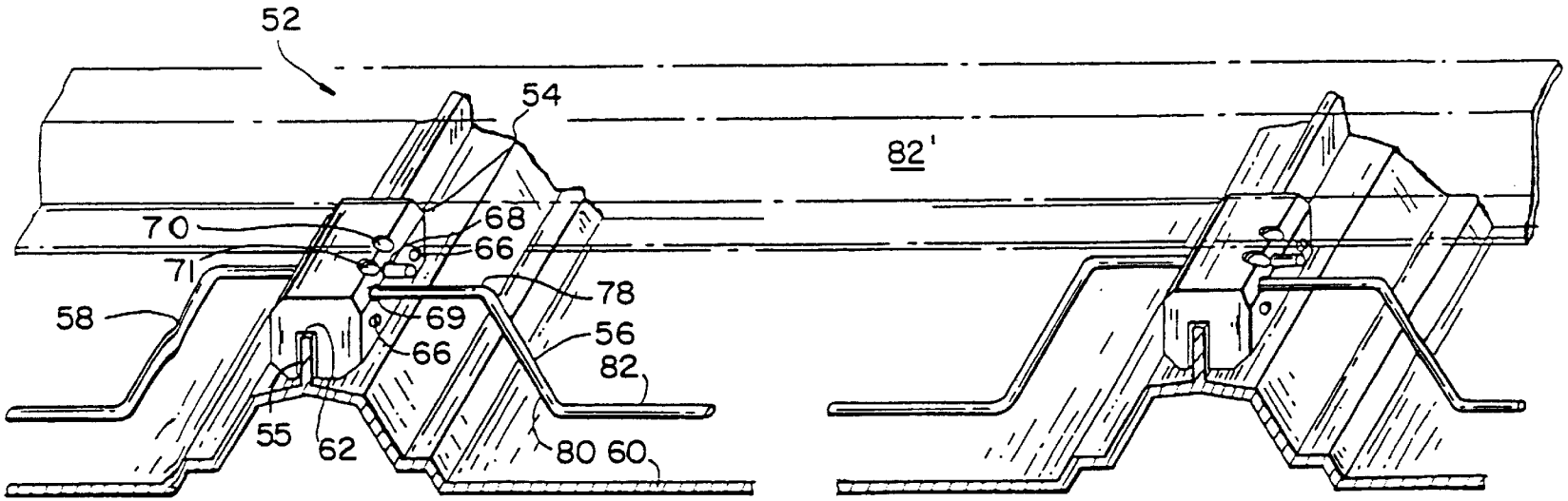
FIG. 5*b* is the assembly of FIG. 5*a* with an additional cross-member of a first configuration utilized therewith.
Figure 5C:
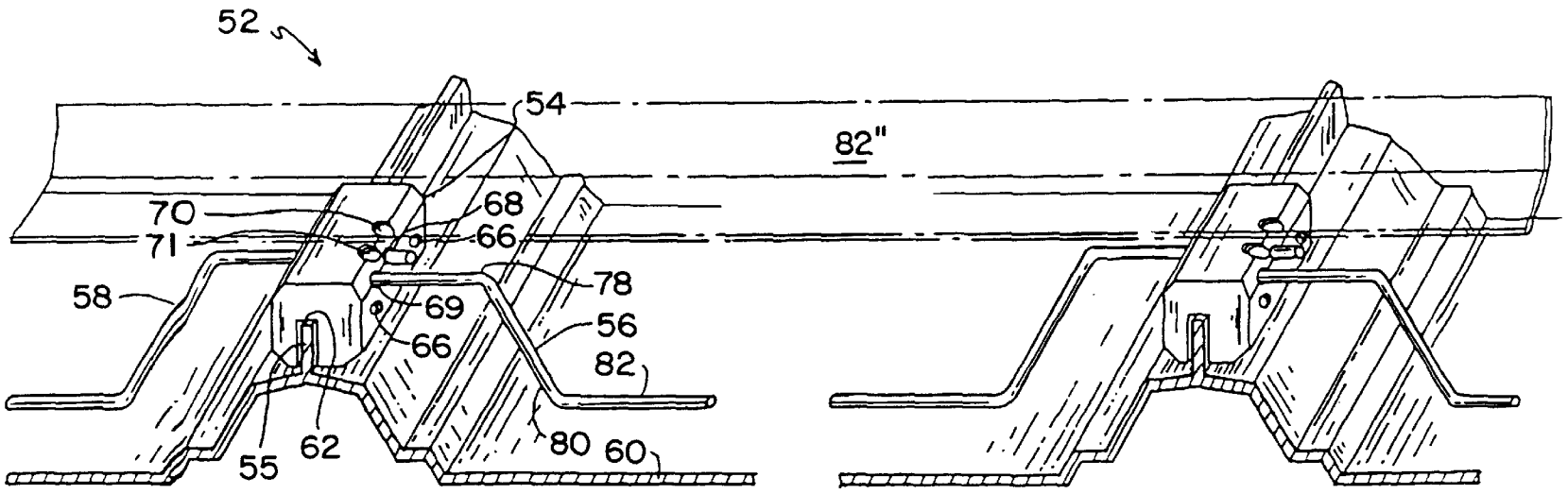
FIG. 5*c* is the assembly of FIG. 5*a* with an additional cross-member of a second configuration utilized therewith.
Figure 6A:
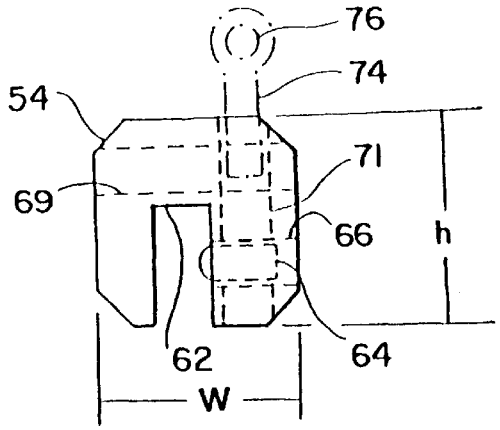
FIG. 6*a* is a front view of a mounting device constructed in accordance with one embodiment of the present invention.
Figure 6B:
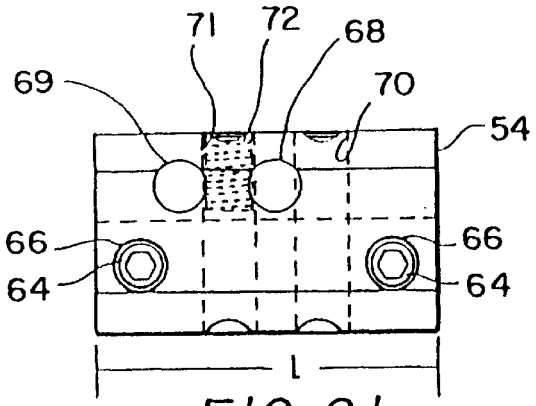
FIG. 6*b* is a right side view of the mounting device of FIG. 6*a;*
Figure 6C:
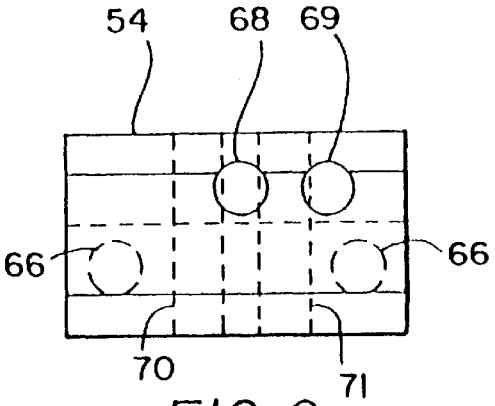
FIG. 6*c* is a left side view of the mounting device of FIG. 6*a;*
Figure 6D:
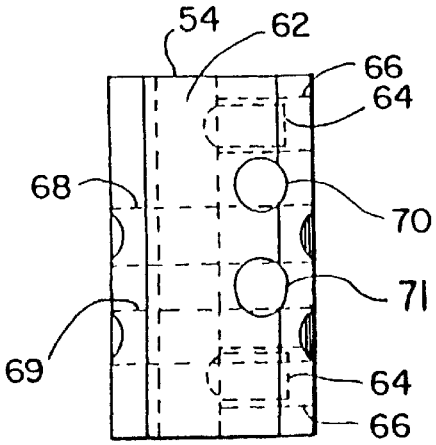
FIG. 6*d* is a top view of the mounting device of FIG. 6*a;*
Figure 6E:
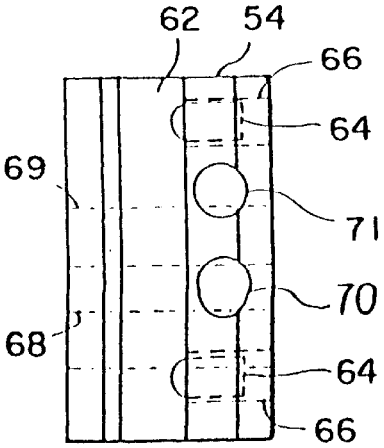
FIG. 6*e* is a bottom view of the mounting device of FIG. 6*a;*

Referring to FIGS. 5–6*e,* roof assembly 52 utilizes a mounting device of the present invention. The roof assembly 52 comprises a number of mounting devices 54 attached to ridges 55 (only two mounting devices 54 being required) and at least one cross-member 56 or 58 positioned above the roof 60 and between the adjacent mounting devices 54. The roof assembly 52 is suitable for use in roofing applications similar to those described above, such as those formed by standing seam interconnections for adjacent panel sections.

The mounting device 54 is similar in many respects to the mounting device 12 described above. The mounting device 54, which may be formed from anodized aluminum and by extrusion, is provided with a slot 62 to receive ridge or standing seam 55. A pair of set screws 64 (similar to screws 30) are threadably extendable from bores 66 into slot 62 to engage, without piercing, ridge 55. As noted above, at least two screws 64 are preferred for attaching each mounting device 54 to a seam 55. Once again, this forces the ridge 55 against the opposing sidewall of the slot 62. However, unlike the mounting device 12 described above, the illustrated mounting device 54 is adapted to simultaneously receive two laterally displaced cross-members 56 and 58.

The mounting device 54 is adapted for use in either a vertical or a horizontal configuration as in the case of the mounting device 12, although only the vertical orientation is illustrated in FIGS. 5*a*–5*c*. Referring to FIGS. 6*a*–6*e*, the mounting device 54 is therefore provided with two side-to-side openings 68 and 69 (oriented similar to opening 36 discussed above) for receiving cross-members 56 and 58 in the vertical configuration (i.e., with the slot 62 projecting down toward the roof 60 as illustrated in FIG. 5) and two top-to-bottom openings 70 and 71 (oriented similar to opening 42 discussed above) for receiving cross-members 56 and 58 in the horizontal configuration (i.e., with the slot 62 projecting substantially parallel to the roof 60 as shown by the mounting device 12 in FIG. 4*a*). In the horizontal configuration, at least one of the side-to-side openings 68 and 69 can intersect at least one of the top-to-bottom openings 70 and 71 so that a set screw 72 can be inserted through the opening(s) 68 and/or 69 to positionally secure the cross-members 56 and 58 in the openings 70 and 71. Similarly, in the vertical configuration, set screw 72 can be inserted through at least one of the openings 70 and 71 to positionally secure the cross-members 56 and 58 within openings 68 and 69. In the illustrated embodiment, opening 68 intersects both openings 70 and 71, and opening 71 intersects both openings 68 and 69, such that a single set screw 72 can be used to secure both cross-members 56 and 58 in either the horizontal or the vertical configuration. Thus, the openings 68 and 71 can be partially threaded as shown. It will be appreciated that an eye bolt or other extension 74 (shown in phantom) can be used in place of set screw 72 to provide for an additional member 76 (phantom) if desired and/or to provide an alternative means for adjusting a distance between the roof 60 and the member 76 (i.e., by varying the length of the eye bolt 74). Moreover, a cross-member 82' of an L-shaped configuration and/or a cross-member 82" of a Z-shaped configuration, as well as other appropriate configurations, may be appropriately attached to the mounting devices 54 (e.g., by using a bolt (not shown) to threadably engage the associated mounting device 54) as illustrated in FIGS. 5*b* and 5*c*, respectively.

As noted above with regard to mounting device 12, a primary function of openings 68/69 and 70/71 is to accommodate for multiple orientations of the device 54 on a seam 55. Consequently, the above-noted intersection of opening 68 with openings 70 and 71 and the intersection of opening 71 with openings 68 and 69 is not required. That is, the openings 68, 69, 70, 71 may be spaced and non-intersecting and set screw holes (not shown) may be separately formed in the device 54 to secure cross-members 54, 56 thereto by conventional set screws if desired.

Although the physical size of the mounting device may be modified to accommodate for a given application, in one embodiment the mounting device 54 has a height, h, of about 1.6 inches; a width, w, of about 1.6 inches; and a length, l, of about 2.5 inches. The slot 62 in this embodiment is about 0.9 inches deep (high) and 0.4 inches wide. The openings 68, 69, 70 and 71 have a diameter of about ⅜ inch. Such dimensions have been found suitable for a broad range of roofing applications. In order to provide for a desired degree of stability of the device 54 when attached to a standing seam 55, the length of the slot 62 (which in the illustrated embodiment is equal to the length of the device 54) should exceed at least one of the height of the slot 62 and the width of the slot 62, the length of the mounting device 54 should be at least about 1½ inches, and/or multiple screws 64 should be used.

It may be desirable to be able to adjust the height of at least a portion of the cross-members 56 and 58 over the surface of the roof 60 to modify the control of snow and/or ice movement. Thus, for example, a variety of openings may be provided in mounting device 54 to allow adjustment of the positioning of cross-members 56 and 58 (not shown), or the cross-members 56 and 58 can otherwise be attached to the mounting device 54 at variable heights. In the illustrated embodiment, cross-members 56 and 58 are provided with bent shapes, defined by substantially horizontal end portions 78, sloping portions 80, and substantially horizontal central portions 82, such that the height of the central portion 82 relative to the surface of the roof 60 can be varied by pivoting or rotating members 56 and/or 58 relative to mounting devices 54. The height of the central portions 82 can thus be adjusted by pivoting or rotating members 56 and 58 until the desired height is achieved and then tightening the set screw 72 to secure the members 56 and 58 in the selected position. In this manner, the height of the central portions 82 can be steplessly adjusted across a broad range of heights. In addition, the central portions 82 can be positioned at heights lower than the mounting devices 54 as shown, such that portions 82 can be positioned close to the surface of the roof 60, as may be desired, even where the mounting devices 54 are attached to relatively tall ridges.

Figure 7:
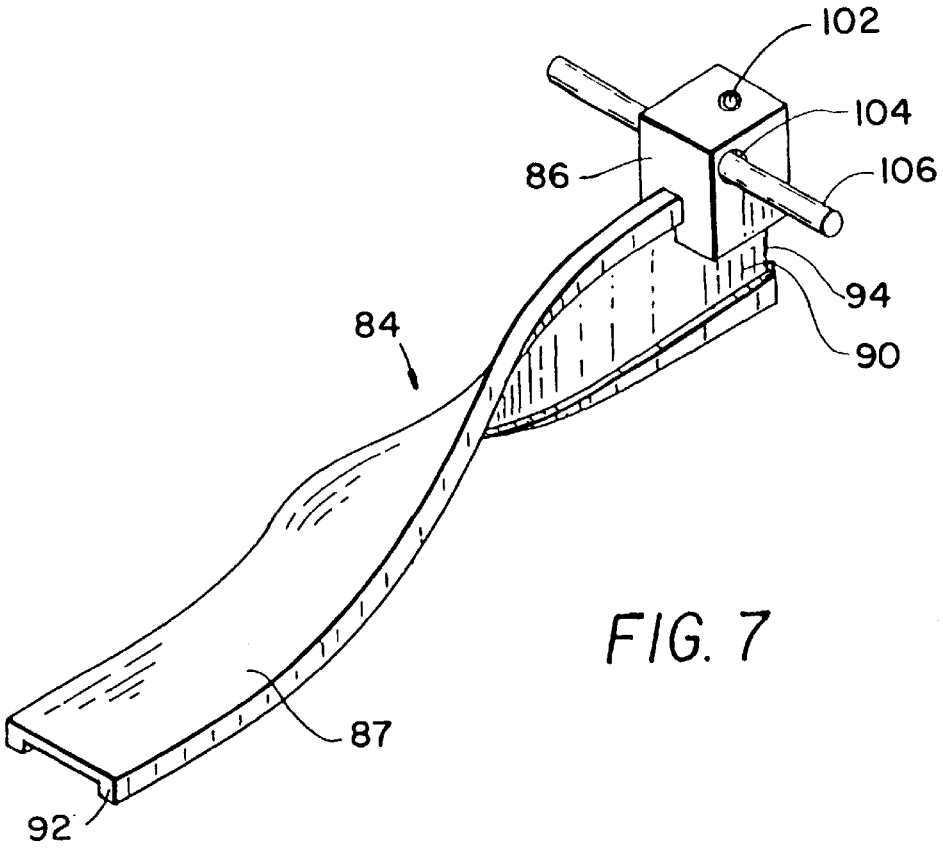
FIG. 7 is a perspective view of an adapter and mounting device constructed in accordance with another embodiment of the present invention.
Figure 8:
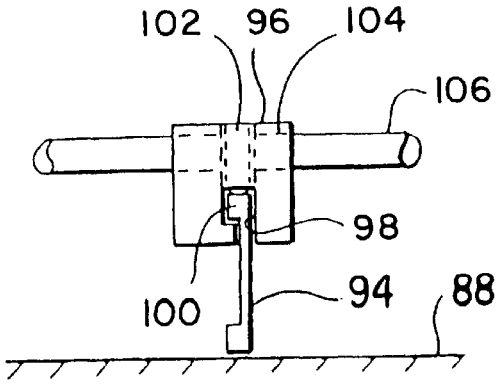
FIG. 8 is a front view of the adapter and mounting device of FIG. 7.

Referring to FIGS. 7 and 8, an adaptor constructed in accordance with the present invention is generally identified by the reference numeral 84. The adaptor can be utilized to allow attachment of a mounting device 86 to, for instance, a roof 88 where a ridge or standing seam is not present. The adaptor 84 comprises a securement portion 87 which lies prone on the roof 88 and a second, raised portion 90 which functions analogously to the ridges/standing seams in the above-described embodiments to provide a surface for attachment of the mounting device 86. In this regard, the adaptor 84 can have a right angle cross-section, e.g., a generally T-shaped or L-shaped cross section, including a base portion for securement to the roof 88 and an upwardly projecting portion. In the illustrated embodiment, the adaptor 82 comprises a twisted aluminum strip having a first, substantially horizontal end 92 and a second, substantially vertical end 94.

The mounting device 86 can comprise an aluminum body 96 having a slot 98 therein for receiving the raised portion 90 of adaptor 84. The slot 98 and raised portion 90 can be provided with complementary shapes. As shown, the slot 98 has a generally "L" shaped cross-section to receive a flanged portion 100 of the adaptor 84. A set screw 102 can be inserted through mounting device 86 to frictionally engage the adaptor 84, thereby securing the mounting device 86 thereto. The mounting device 86 is further provided with an opening 104 for receiving a cross-member 106 such as described above. The mounting device 86 can thus be used to position the member 106 on the roof 88 by attaching the securement portion 87 to the roof 88, e.g., by using an adhesive, nails, screws or the like; securing the mounting device 86 to the raised portion 90 of the adaptor 84; and sliding the cross-member 106 through opening 104 of the adaptor 84. Although the mounting device 86 has been described as such, this alternative installation method may be used with configurations of mounting devices as described above.

Figure 9:
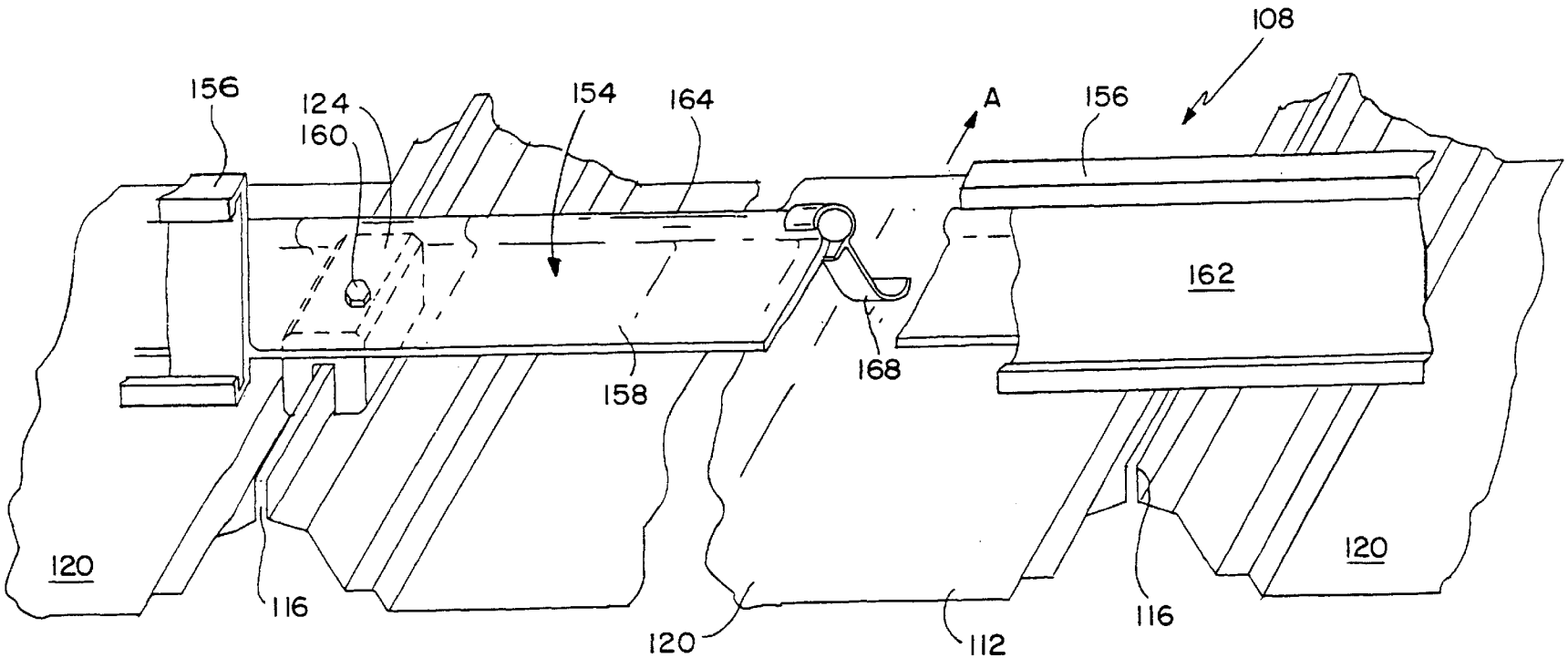
FIG. 9 is a perspective view of an assembly for one application of the present invention.

A roof assembly 108 is illustrated in FIG. 9 and presents another application of the present invention. Generally the assembly 108 is positionable upon a roof 112 having spaced raised portions or standing seams 116 with lower base portions 120 therebetween. The roof 112 will typically be formed from metal sheet panels such that the raised portions 116 are standing seams 116. In FIG. 9, the peak or elevated portion of the roof 112 is in the direction of the arrow A such that the seams 116 run in a generally downward direction away from the peak.

The roof assembly, 108 generally includes at least two mounting devices 124 which are attached to displaced standing seams 116, a cross-member assembly 154 which extends between the mounting devices 124, and at least one clip 168 attached to the cross-member assembly 154 for engaging the roof 112 on one of its base portions 120.

Figure 10A:
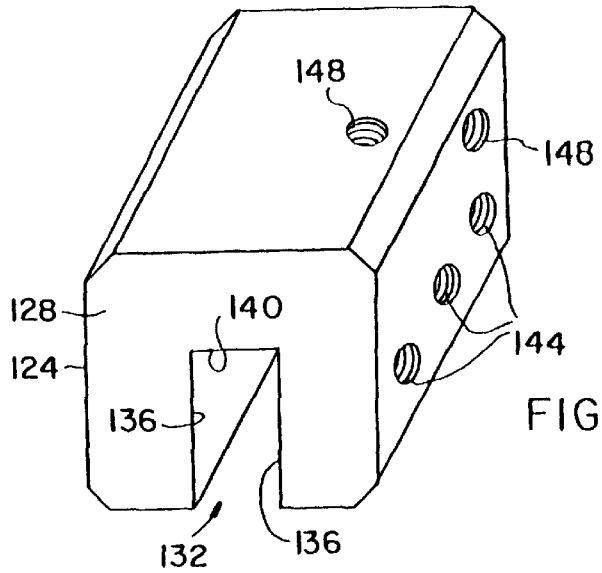
FIG. 10*a* is a perspective view of one embodiment of a mounting device of the present invention.
Figure 10B:
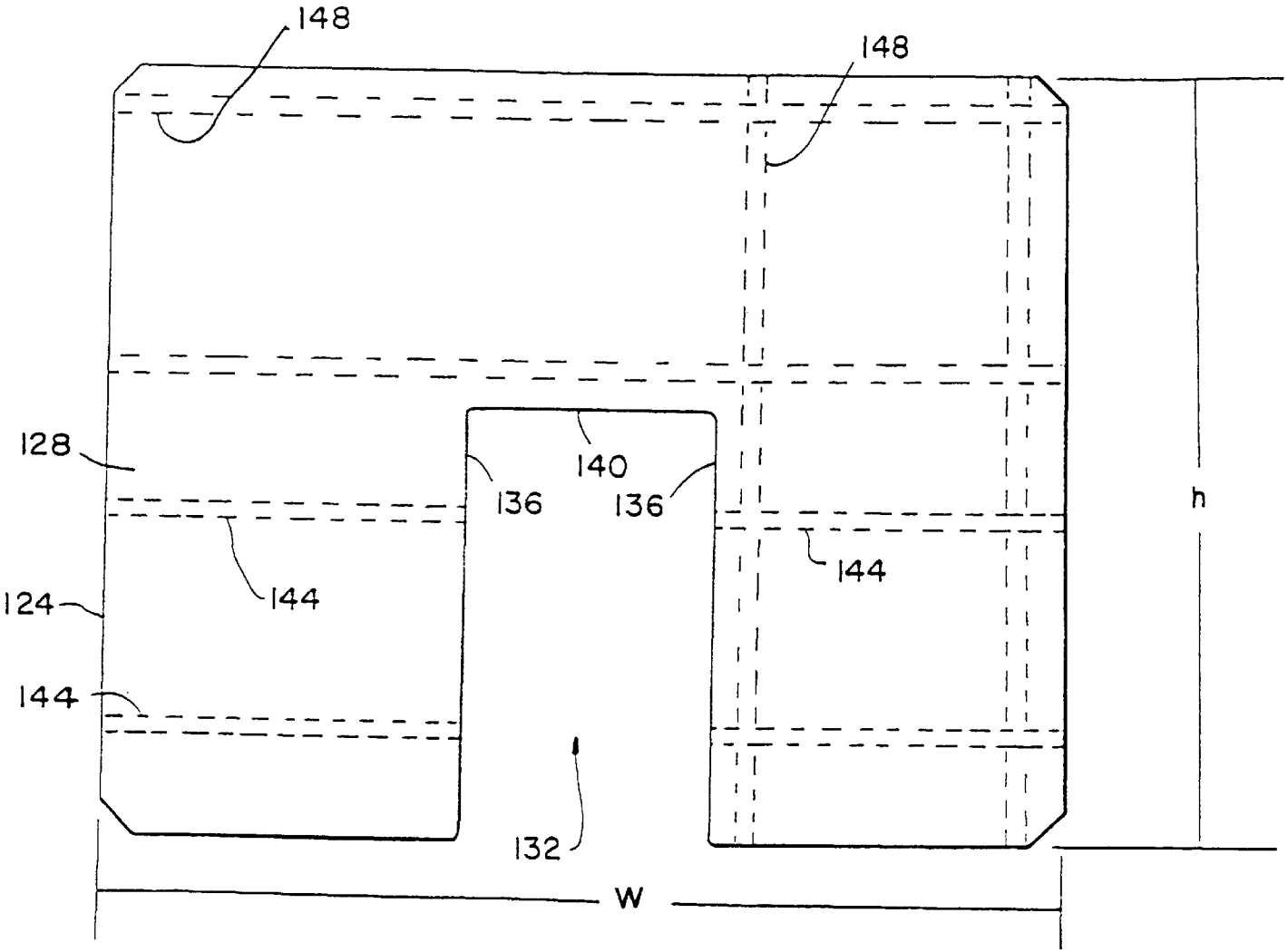
FIG. 10*b* is a front view of the mounting device of FIG. 9.
Figure 10C:
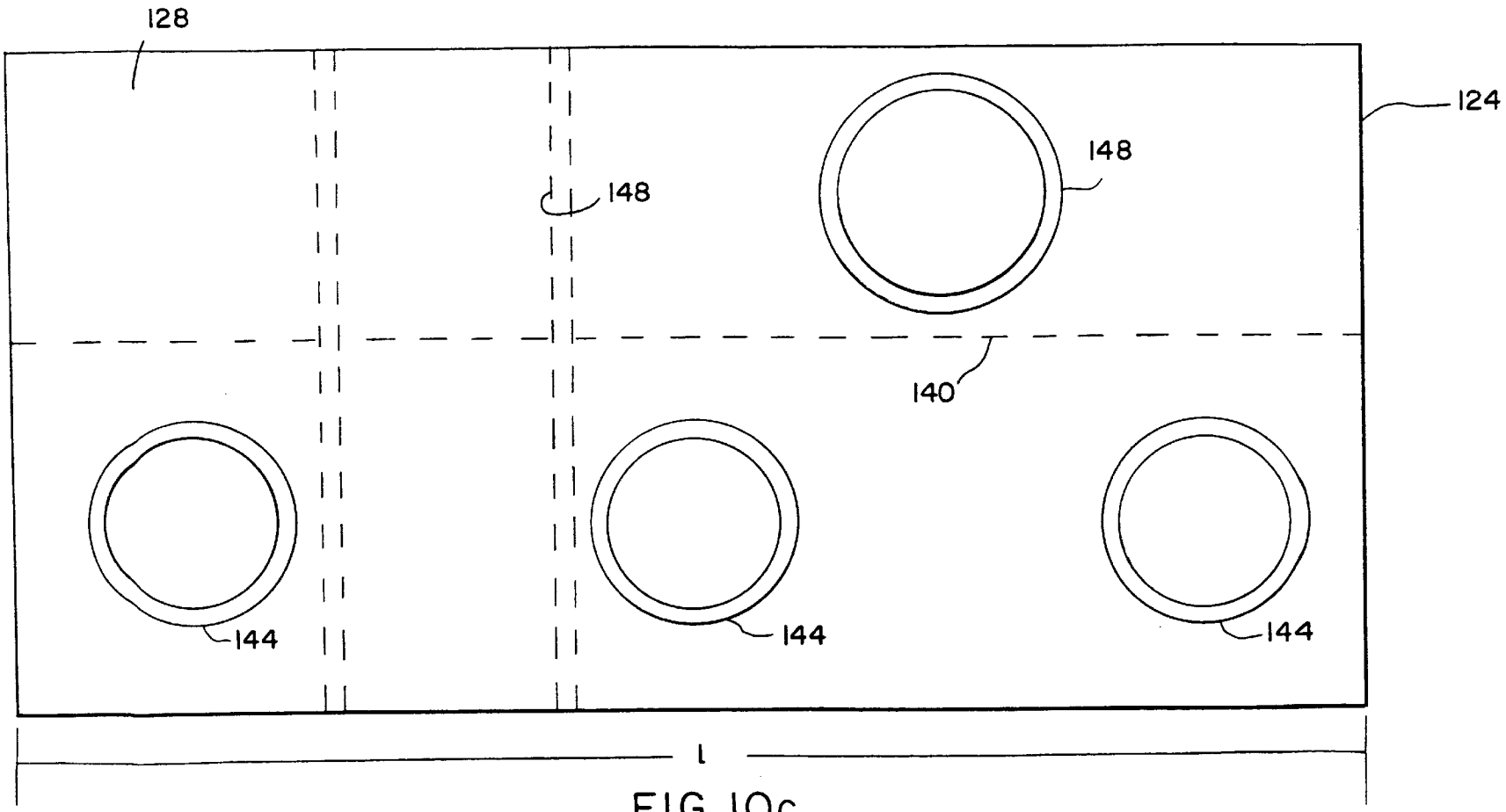
FIG. 10*c* is a right side view of the mounting device of FIG. 10*a;*

One embodiment of the mounting device 124 is more particularly illustrated in FIGS. 10*a*–10*c*. Generally, the mounting device 124 includes a substantially rigid, unitary mounting body 128 (e.g., formed from materials such as aluminum, zinc, brass, stainless steel, and alloys thereof) which may be formed by extrusion. A slot 132 extends longitudinally through the mounting body 128 and is formed by two substantially parallel sidewalls 136 with an integral bottom 140 therebetween. The slot 132 is thus able to be positioned over the top of a standing seam 116 for attachment of the mounting device 124 thereto. Moreover, the position of the sidewalls 136 relative to each other remains substantially constant due to the rigidity of the body 128. Since the function of the slot 132 is to receive the seam 116, other configurations may be utilized for the slot 132.

Figure 11:
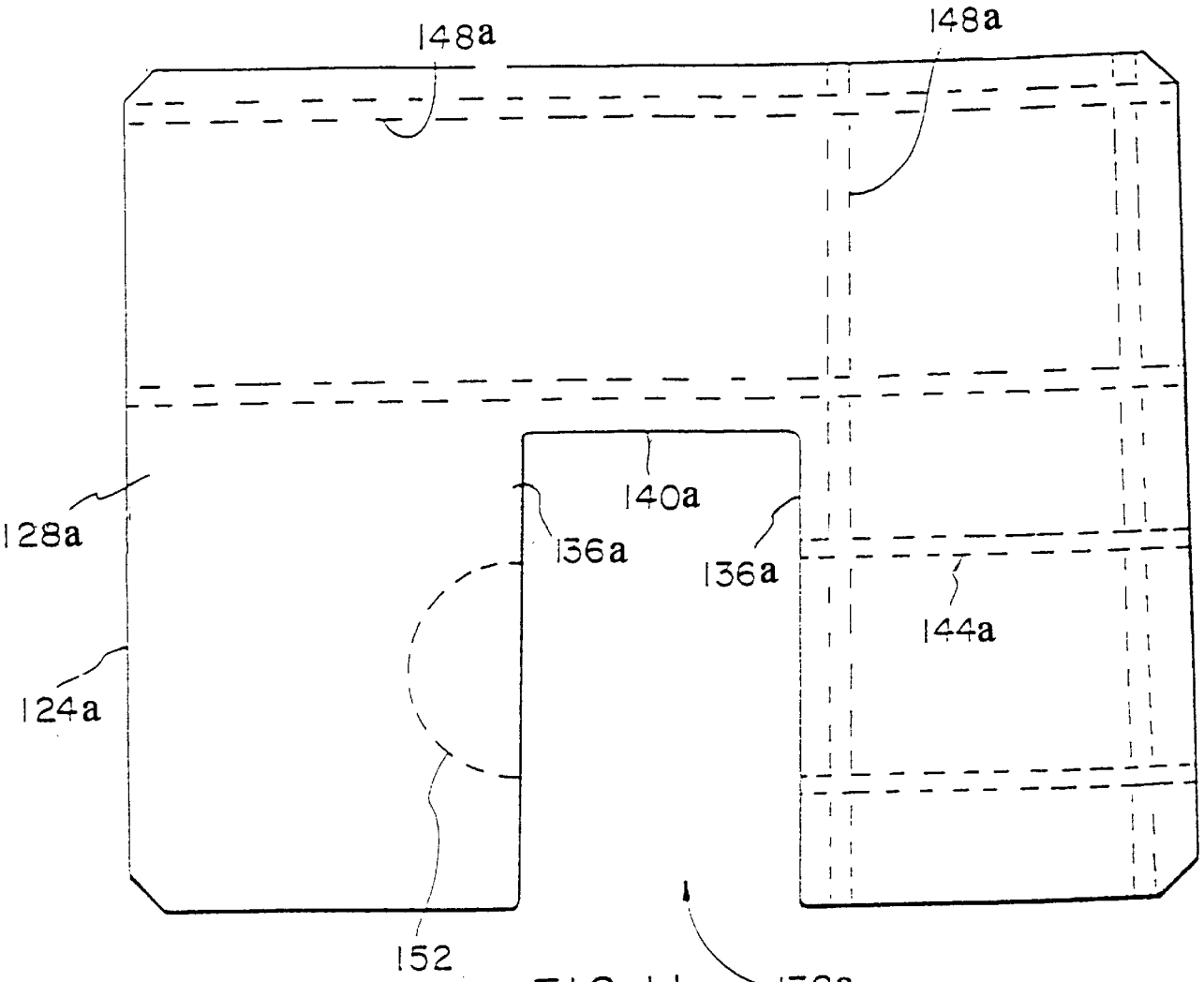
FIG. 11 is a front view of one embodiment of a mounting device of the present invention.

In order to secure the mounting device 124 on a standing seam 116, a plurality of threaded securing bores 144 (three shown although the size of the mounting body 128 may allow for/dictate the use of more or less bores 144) extend through the body 128 from a side of the mounting device 124 to one of the sidewalls 136 which defines the slot 132. In the embodiment of FIGS. 10*a–c,* these threaded securing bores 144 are provided in the body 128 on each side of the slot 132 and may include counterbores. Consequently, appropriate fasteners such as the above-described blunt-nosed set screws 30 may be positioned in the threaded securing bores 144 to secure the mounting device 124 on a standing seam 116. One alternative is to use screws 30 in one or more of the threaded securing bores 144 on each side of the slot 132 to secure the mounting device 124 onto the seam 116. However, typically screws 30 are positioned in threaded securing bores 144 on only one side of the slot 132 such that the standing seam 116 will be forcibly engaged between the non-piercing end(s) 32 of the screw(s) 30 and the opposing sidewall 136 of the slot 132 at displaced locations. In this case, portions of the standing seam 116 coinciding with a screw 30 may deform into the threaded securing bore 144 opposing the screw 30 to enhance the securement of the mounting device to the standing seam 116. A similar effect may be achieved with the mounting device 124*a* of FIG. 11 in which a dimple 152 is positioned in linear opposition to a threaded securing bore 144*a*.

The mounting devices 124 also include features which allow for the mounting of various attachments thereon. For instance, the mounting devices 124 each have two threaded mounting bores 148 which may include counterbores (e.g., to provide a shoulder to seat within the mounting body 128 to a degree). These mounting bores 148 extend through the body 128 in different orientations (substantially perpendicular in the FIG. 10*a–c* embodiment and similarly to openings 36, 42 with regard to the orientation thereof relative to the slot 132) and are positioned on substantially planar surfaces as noted above with regard to openings 36, 42. As noted above, this allows the mounting device 124 to be used with different orientations of a standing seam (e.g., FIGS. 3–4) and this multiple orientation of the threaded mounting bores 148 may also be further desirable for certain applications where multiple attachments may be required.

Although the physical size of the mounting device 124 may be modified to accommodate for a given application, in one embodiment the mounting device 124 has a height, h, of about 1.25"; a width, w, of about 1.500"; and a length, l, of about 2.50". The slot 132 in the embodiment is about 0.70" deep (high), and about 0.40" wide. Threaded mounting bores 148 have a diameter of about 0.375". In order to provide for a desired degree of stability for the mounting device 124 when attached to a seam 116, the length of the slot 132 (which in the illustrated embodiment is equal to the length of the mounting device 124) should exceed at least one of the height of the slot 132 and the width of the slot 132, the length of the mounting device 124 should be at least about 1½ inches and/or multiple fasteners (e.g., blunt nosed screws 30) should be used.

Figure 12:
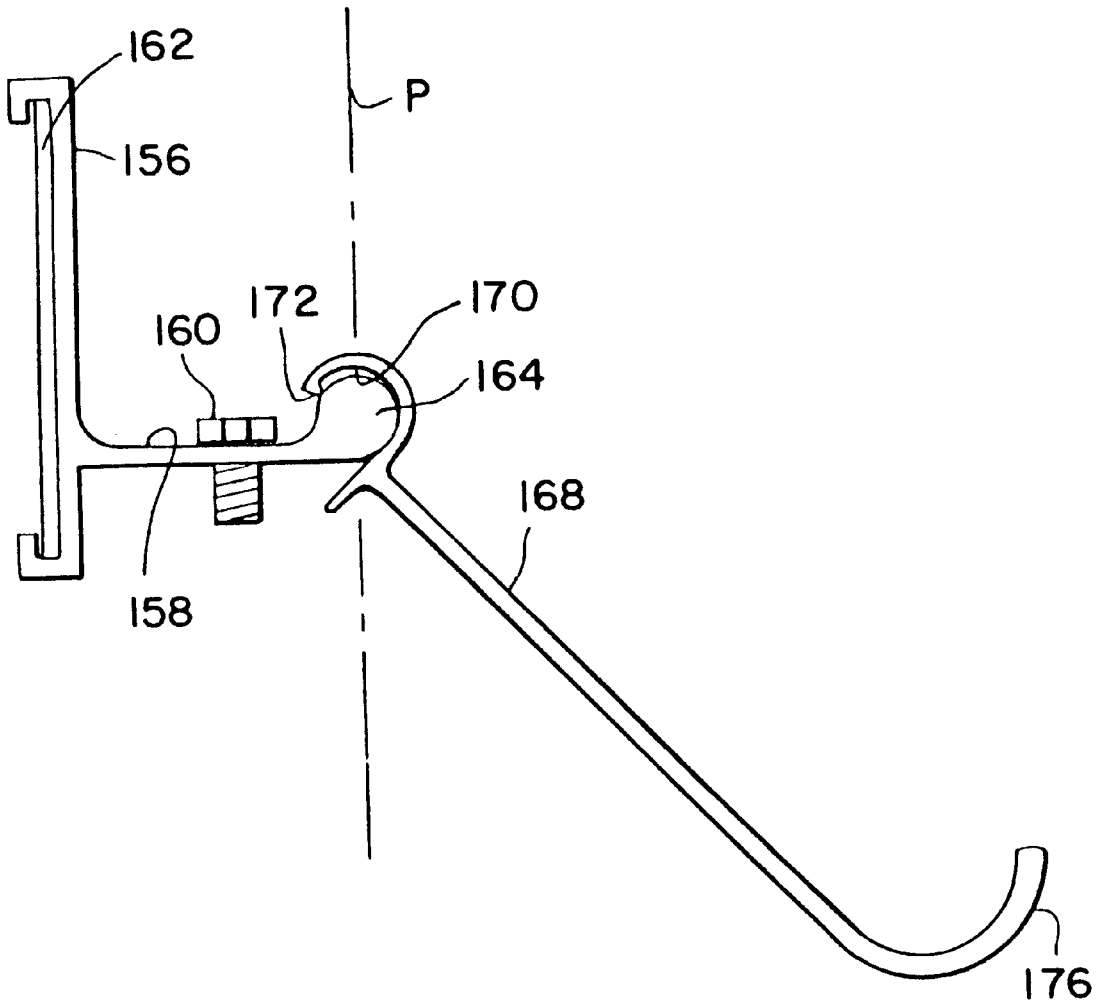
FIG. 12 is an end view of the assembly of FIG. 9.
Figure 15A:
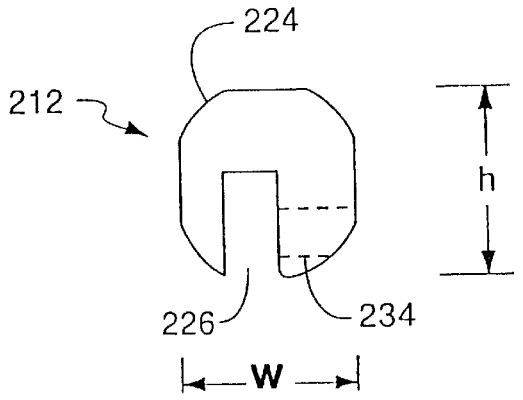
FIG. 15*a* is a front view of a clamp constructed in accordance with one embodiment of the present invention.
Figure 15B:
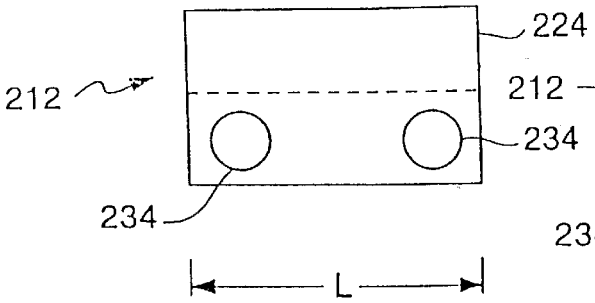
FIG. 15*b* is a right side view of the clamp of FIG. 15*a;*
Figure 15C:
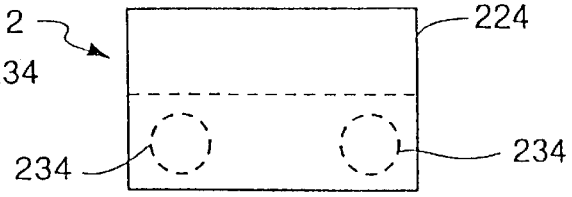
FIG. 15*c* is a left side view of the clamp of FIG. 15*a;*
Figure 15D:
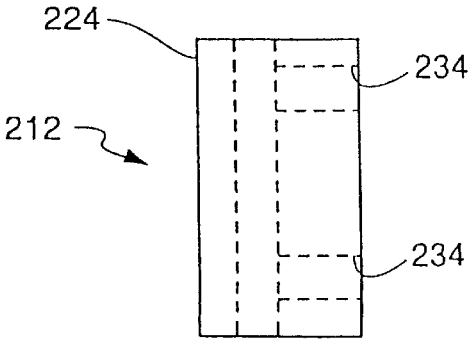
FIG. 15*d* is a top view of the clamp of FIG. 15*a;*
Figure 15E:
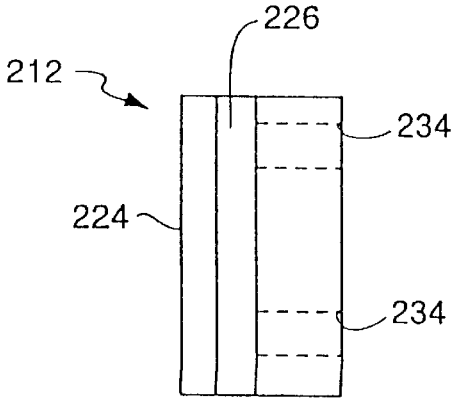
FIG. 15*e* is a bottom view of the clamp of FIG. 15*a;*

The cross-member assembly 154 of the roof assembly 108 (FIGS. 9 and 12) is positioned on an exterior supporting surface of the mounting device 124 (e.g., its upper surface in FIG. 9) and is secured thereto by a bolt 160 which is secured within one of the threaded mounting bores 148. Although the use of mounting device 124 is preferred for this interconnection, other fasteners may be employed. The cross-member assembly 154 includes a channel 156, central panel 158, and rod 164. Generally, the channel 156 is longitudinally extending and configured so as to slidably receive an insert 162 which may be color coordinated with the roof 112 to improve upon the aesthetics of the roof assembly 108 (e.g., the insert 162 may be cut to size from a sheet metal panel which forms the roof 112). However, the channel 156 may also contribute to the controlling of the movement of snow and/or ice down the pitch of the roof 112.

The rod 164 is interconnected with the channel 156 by a central panel 158. The central panel 158 actually serves as the interfacing surface between the cross member assembly 154 and the mounting devices 124. Moreover, the rod 164 serves to control the movement of snow and/or ice down the pitch of the roof 112 similar to the various other cross members discussed above. Although the cross-member assembly 154 may be integrally formed by extrusion, the channel 156, central panel 158, and rod 164 may be separate pieces which are appropriately joined together, such as be welding.

In certain applications, it may be desirable to position one or more of the clips 168 between adjacent standing seams 116. In this regard, clip 168 includes an arcuate cavity 170 which may be positioned around at least a portion of the rod 164. A detent 172 projects inwardly toward the cavity 170 and serves to snap-fit the clip 168 onto the rod 164. In order to maintain the clip 168 on the rod 164, the detent 172 should be positioned on the opposite side of a vertical plane P extending through the rod 164 than the peak or elevated portion of the roof 112. Consequently, the clip 168 extends generally from the rod 164 toward the elevated portion or peak of the roof 112 at an angle into engagement with the base panel 120. In order to reduce the potential for roof damage due to this engagement, the clip 168 includes a generally arcuate end 176.

Those skilled in the art will appreciate that various modifications and adaptations of the described embodiments of the present invention are possible. For example, the various mounting devices described above may be used in connection with applications other than the snow or ice movement controlling applications described above. Thus, the mounting devices can be utilized to attach walkways, guy wires, worker safety lines, signs or other building components to a roof, wall or the like having a raised portion, such as by utilizing one or more of the described types of openings (preferably being threaded within the respective mounting device). For instance, the described eye bolts 48 may be positioned on the mounting device 12 to be used as a guy wire or the like, either alone or in combination with the controlled movement of snow and/or ice provided by the cross-member 18. In addition, the snow or ice blocking members described above may be provided as hollow tubes containing a heater element to melt snow or ice on roofs.

Figure 13:
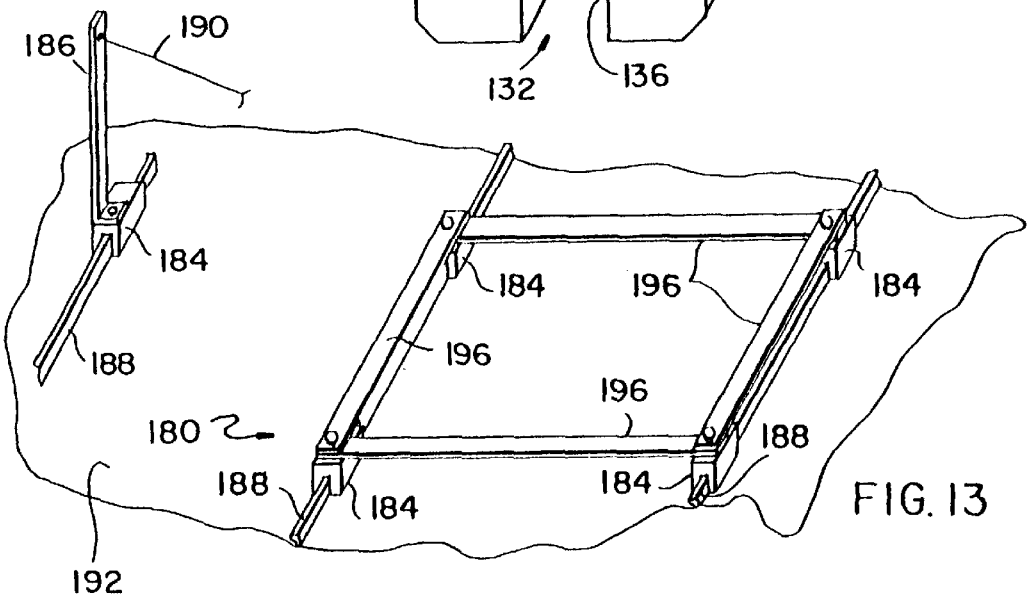
FIG. 13 is a perspective view of an assembly for one application of the present invention.
Figure 14:
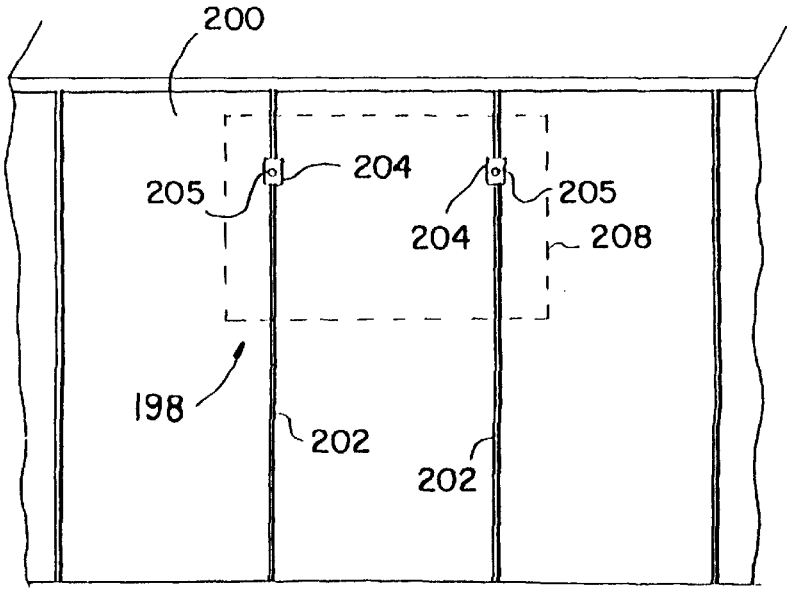
FIG. 14 is a perspective view of an assembly for one application of the present invention.

As an illustration of these other types of applications of the present invention, reference may be made to FIGS. 13 and 14. For instance, the roof assembly 180 of FIG. 13 illustrates that the mounting device 184 (similar to those discussed above) may be positioned on the standing seams 188 of a substantially flat roof 192 such that a frame structure 196 may be constructed thereon for supporting various types of equipment (not shown). In this case, it may be desirable to attach another mounting device 184 to an adjacent standing seam 188 and position an extension 186 thereon (e.g., through one of its threaded mounting bores not shown) such that a guy wire 190 may extend between such equipment and the extension 186.

The siding assembly 198 of FIG. 14 illustrates another application of the present invention. In this case, mounting devices 204 (similar to those discussed above) are attached to the standing seams 202 on a sidewall 200 of a building structure such that a sign 208 may be mounted thereon (e.g. by passing bolts (not shown) through the threaded mounting bores 205 in the mounting devices 204).

In another application of the present invention, the clamp or mounting device illustrated in FIGS. 15*a*–15*e* and FIGS. 16–22, as well as any of the above-described mounting devices, may be used for controlling the uplift of a metal roof. In particular, in metal roofs comprising a plurality of interconnected panels 220, the clamp 212 disclosed and described herein may be used to secure panels 220 at the raised or standing seams 214 adjoining adjacent panels 220, and including where the interconnected panels 220 are anchored to the substructure of the roof (e.g., the frame). As illustrated in FIGS. 16–22, the clamp 212 is positionable on and attachable to and may be used with generally horizontally or vertically oriented raised seams 214 as in the above-described embodiments.

The clamp 212 controls uplift of metal roofs by receiving and frictionally engaging raised seams 214 of adjacent metal panels 220 of a roof within the integrally formed slots 226 extending therethrough, as defined by two sidewalls. Each unitary mounting body 224 also includes at least one bore or hole 234 extending from an outer wall of the unitary mounting body 224 to one or more of the sidewalls of the slot 226. In a preferred embodiment, the bore 234 is threaded.

Figure 16:
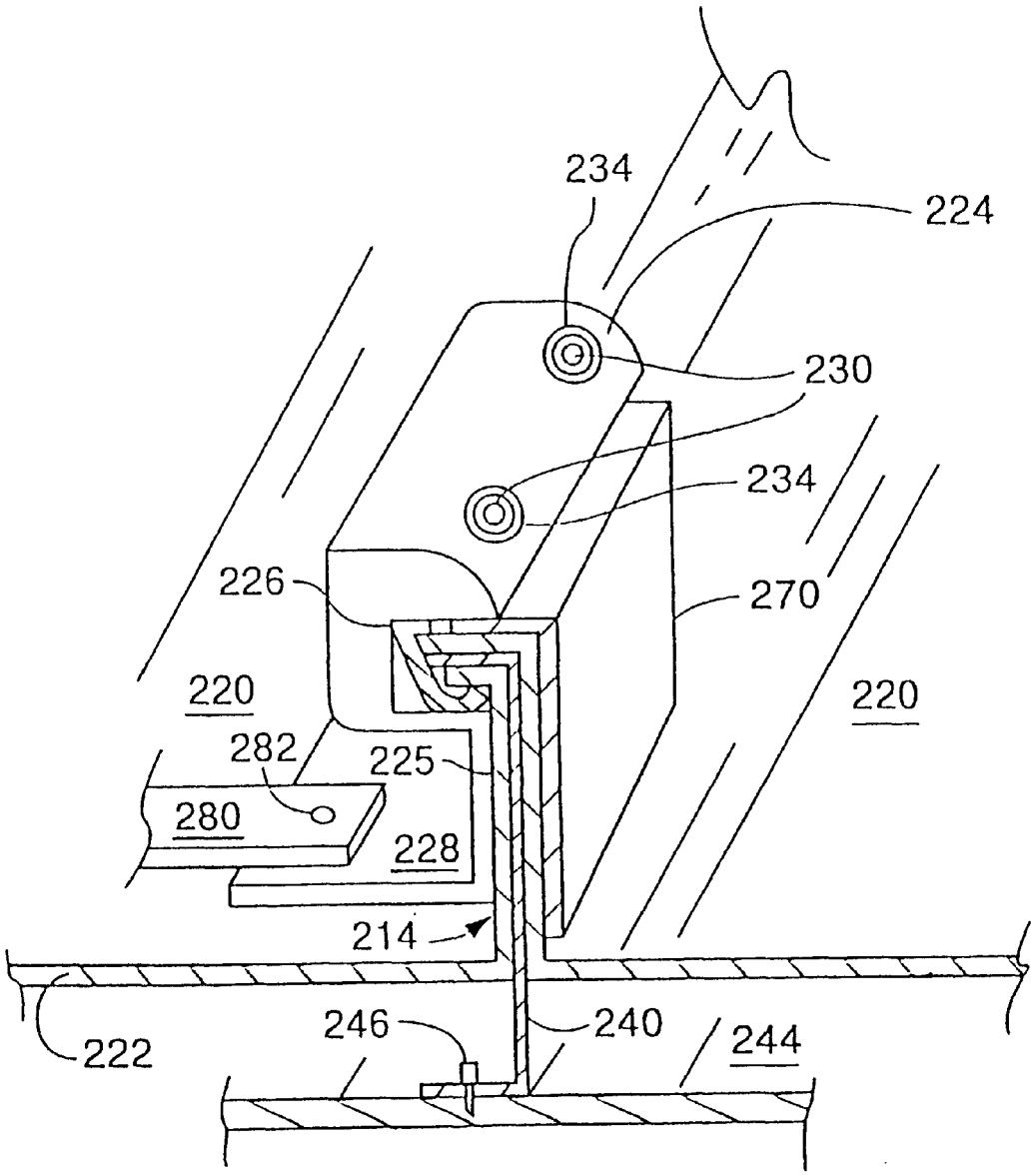
FIG. 16 shows another embodiment of the clamp installed in a generally horizontal configuration.
Figure 17:
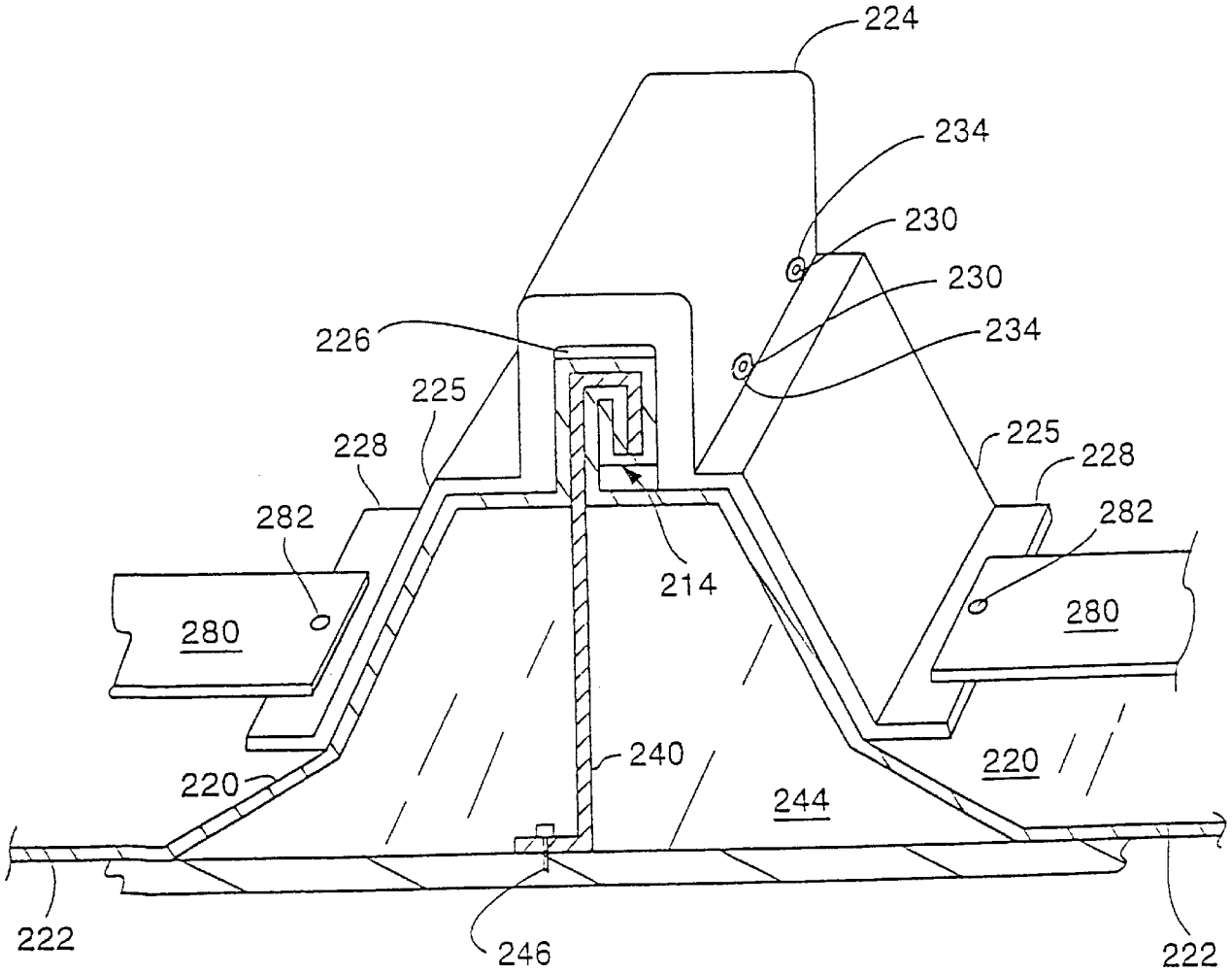
FIG. 17 shows a particular raised seam profile on which another embodiment of the clamp may be installed in a generally vertical configuration.
Figure 18:
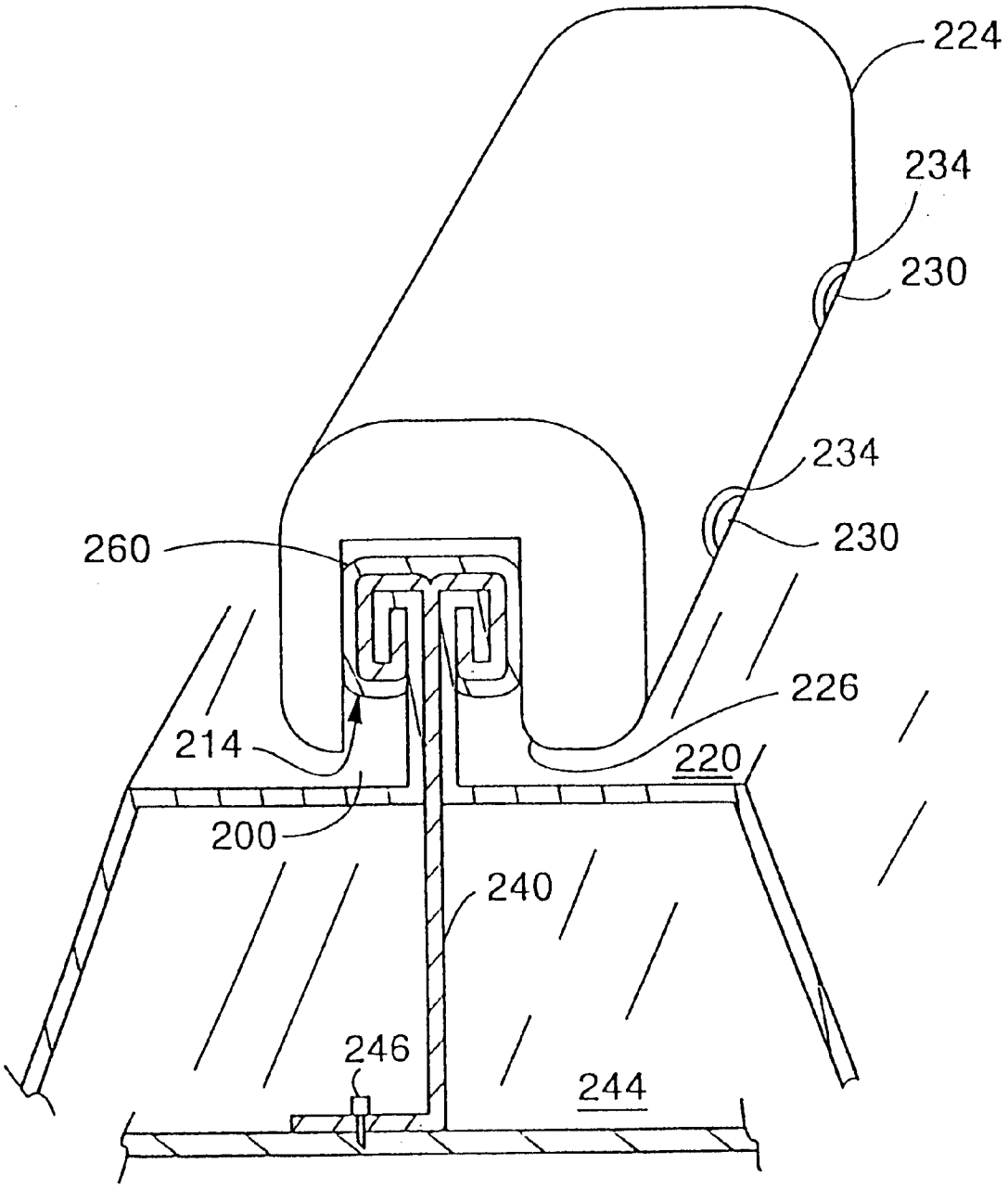
FIG. 18 shows yet another particular raised seam profile on which the assembly of FIGS. 15*a*–15*e* may be installed in a generally vertical configuration.

FIGS. 16 and 17 illustrate another embodiment of the clamp 212 of FIGS. 15*a*–15*e* mounted on straight and trapezoidal type raised seams 214, respectively. In particular, at least one clamp 212 may include at least one portion or leg 225 extending from the unitary mounting body 224. In a preferred embodiment, such legs 225 are integrally formed with the mounting body 224 and extend outwardly from the lower surface a side portion of the mounting body 224 in a direction and/or orientation corresponding to the profile of a portion of the raised seam 214 and/or portion of the roof panels 220. Where the raised seam 214 is substantially vertically oriented, a clamp 212 having at least one downwardly extending leg 225 may be used. Similarly, where the raised seam 214 is substantially horizontally oriented, as shown in FIG. 16, a clamp 212 having a generally laterally extending leg 225 may be used. And, where the raised seam 214 and the corresponding portions of the panels 220 interconnected at the raised seam 214 form a trapezoidal shaped interconnection, a clamp 212, shown in FIG. 17, having a leg 225 disposed at an obtuse angle relative to the unitary body 224, may be used.

The legs 225 are positionable on or near (e.g., in abutting relation against or displaced from) portions of the raised seam 214 and/or the panel 220 in order to provide further control over uplift of the roof panels 220 by providing additional surface area which engages or contacts the seam 214 or panel 220. In this regard, the legs 225 provide further resistance to bowing and/or uplift of the roof panels 220. A first part of an angle member 270, shown in FIG. 16, may be inserted within the slot 226, between a sidewall of the slot 226 and the raised seam 214, such that a second part of the angle member 270 engages the raise seam 214 in abutting relation. The angle member 270 thus provides further control against uplift.

Figure 19:
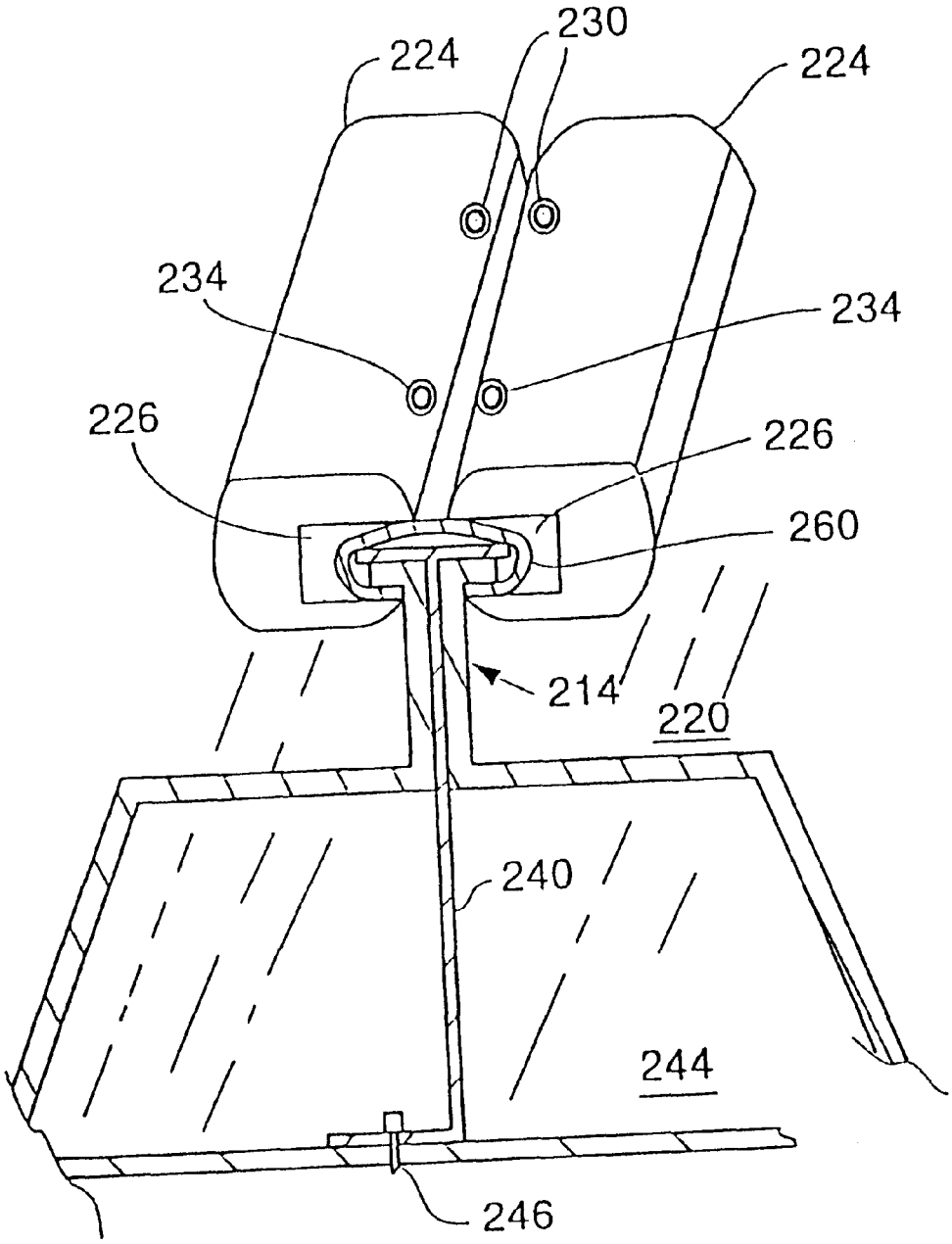
FIG. 19 shows yet another particular raised seam profile on which two assemblies of FIGS. 15*a*–15*e* may be installed in a generally horizontal configuration.
Figure 20:
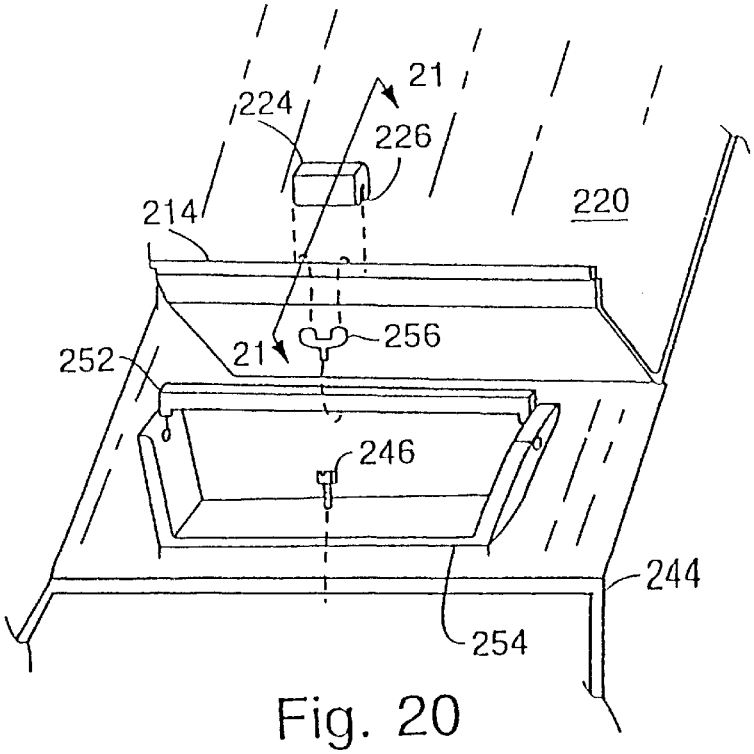
FIG. 20 shows an exploded view of the assembly of FIGS. 15*a*–15*e* which may be installed in a generally vertical configuration.

Upon positioning of a unitary mounting body 224 on a seam 214 such that an upper portion of the seam 214 is received within the slot 226 of the unitary mounting body 224, at least one elongated securing member 230, such as a threaded screw or bolt, may be inserted or threaded into a corresponding bore or hole 234 to preferably frictionally engage and secure an upper portion of the raised seam 214 within the slot 226, thereby interconnecting and securing (e.g., pinching) adjacent metal panels 220 to each other. In fact, for purposes of securing the raised seam 214 within the slot 226, the securing member 230 may force part of the raised seam 214 into a cavity located in the slot sidewall opposite to and aligned with the bore 234. Where applied caps 260 are used to engage raised seams 214, as shown in FIGS. 19–20, the securing member 230 may be attached and secured to the raise seam 214 by frictionally engaging the applied cap 260 enveloping the raised seam 214. Typically, such applied caps 260 engage raised seams 214 in a snap-on fashion.

In order to enhance the uplift resistance, the clamp 212 or any of the mounting devices described above may be positioned and secured to roof seams 214 at specific locations about a roof. Specifically, the unitary mounting body 224 may engage portions of seams 214 in areas of the roof where the panels 220 are anchored to the roof's substructure or frame. This "anchoring" may be provided by attachment clips, as shown in FIG. 16–23, which may be interconnected with the raised seams 214 in an interlocking or male-female fashion. For purposes of structural stability, such attachment clips extend and interconnect raised seams 214 with a roof substructure, such as a purlin 244.

Figure 21:
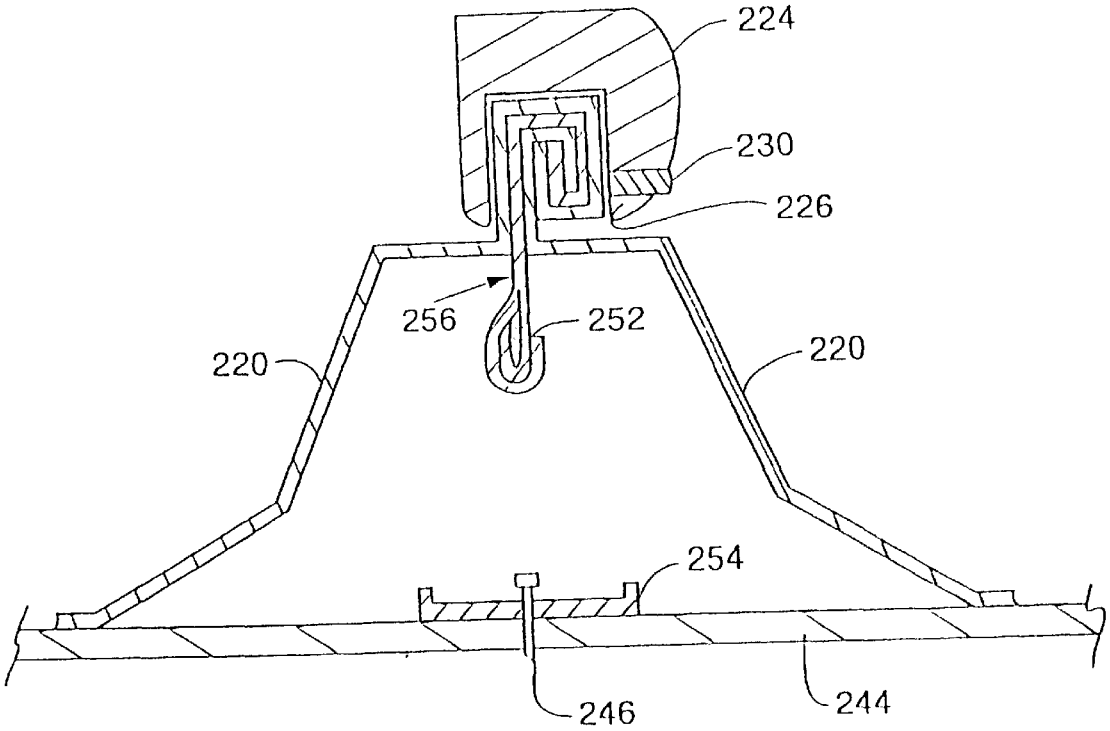
FIG. 21 is a cross-sectional view taken along line 21—21 of the assembly of FIG. 20 installed in a generally vertical configuration.
Figure 22:
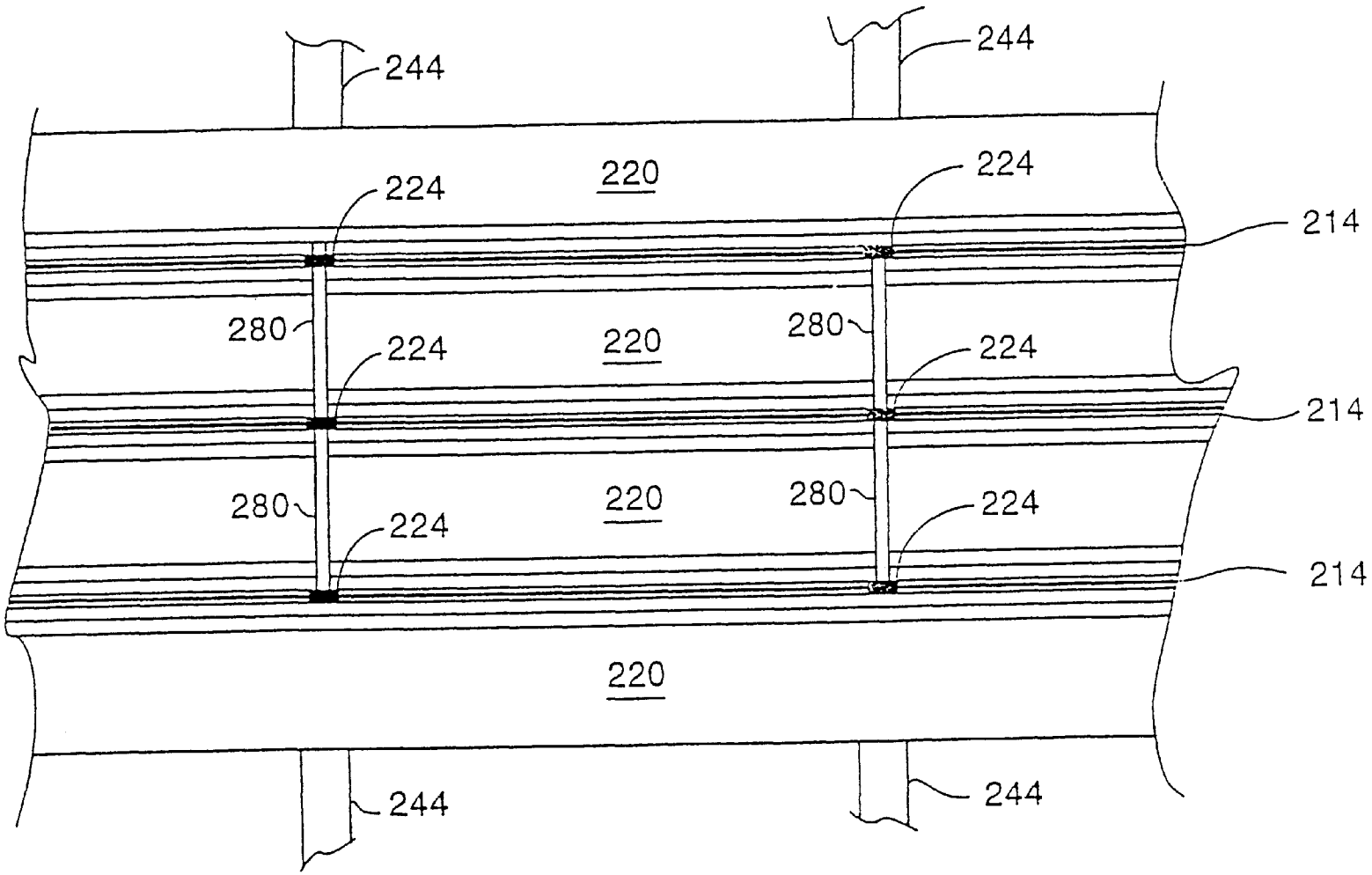
FIG. 22 is a top view of a portion of a metal roof with the clamps of FIGS. 15*a*–15*e* secured to raised seams of the metal roof.

In one embodiment, the unitary mounting bodies 224 may be positioned at locations in which concealed clips 240, shown in FIGS. 16–20, extend between and interconnect roof seams 214 with a purlin 244. For example, as shown in FIGS. 16 and 17, one end of a concealed clip 240 may engage the metal panels 220 at a raised seam 214 while the other end is secured to a purlin 244 by a fastener 246, such as a screw of bolt. Unitary mounting bodies 224 may also be used where panel clips are used, as shown in FIGS. 21–22. Such panel clips may comprise upper and lower portions 252, 254 and a tab 256. The upper portion 252 is interconnected with the raised seam 214 by the tab 256 extending therebetween. Furthermore, the upper portion 252 is interconnected with the lower portion 254 of the panel clip in a snap in engagement, the lower portion 254 being interconnected with the purlin 244 by a fastening member 246.

Further control over uplift of the roof may be accomplished by providing a plurality of cross-members 280 extending between adjacent clamps 212. As illustrated in FIGS. 17 and 22, a plurality of cross-members 280 may be connected to portions of adjacent clamps 212 (e.g., which are attached to adjacent seams 214) to provide further resistance to bowing of the base portions 222 of the panels 220. In a preferred embodiment, such cross-members 280 extend between clamps 212 mounted on seams 214 which are "anchored" to a roof substructure by clips. Cross-members 280 are elongated (e.g., extend longitudinally between first and second ends) and may have a cross-section generally rectangular, square, circular, triangular, elliptical or otherwise parallelogram-shaped (e.g., rhomboidal, trapezoidal, etc.). The cross-members 280 may be fastened to the clamps 212 by a fastening member 282, such as self-drilling fasteners, or by nuts and bolts, screws, nails, staples, or clamps. Alternatively, the cross-members 280 may be connected to the clamps 212 by gluing or welding the cross-members 280 to the clamps 212.

In one embodiment, where clamps 212 are provided with legs 225 and include flanges 228 extending from such legs 225, and clamps 212 are mounted on adjacent seams 214, cross-members 280 may be fastened to the flanges 228 of the clamps 212. Since the flange portions 228 of the clamp 212 are positioned on a lower portion of the clamp 212, cross-members 280 connected to the flanges 228 provide enhanced control over uplift of the base portions 222 of the panels 220 as the cross-members 280 are positioned just above the base portion 222. The flanges 228 may be disposed at an obtuse angle relative to the leg 225 connected thereto, especially where trapezoidal seams are provided, as illustrated in FIG. 17. Alternatively, the flanges 228 may be disposed at approximately 90° relative to the side portion of the unitary body 224, especially where a horizontal seam 214 is provided, as illustrated in FIG. 16. In an alternative embodiment, a plurality of cross-members 280 may extend between adjacent seams 214 and may be connected to the top or upper surface of the unitary body 224 by an appropriate fastening member 282 (not shown). In yet another embodiment, a continuous cross-member may extend over and be attached to a number of clamps 212 mounted on a number of adjacent seams 214 (not shown). In another embodiment, clamps or mounting devices 12 (described above) having openings 36, 42 through which cross-members 18 are positionable, as illustrated in FIGS. 3*a* and 4*a*, may be used to similarly control uplift of panels on roofs.

Although the present invention has been described with respect to specific embodiments thereof, various changes and modifications, in addition to those cited above, may be suggested to one skilled in the art and it is intended that the present invention encompass such changes and modifications as fall within the scope of the appended claims.

What is claimed is:

1. An apparatus attachable to a building roof or wall surface, said surface including a plurality of spaced, longitudinal raised portions, said raised portions extending from an elevated portion of said surface to a lower portion thereof and each being laterally separated by a base portion, wherein said raised portions are positioned a greater distance above a reference plane than said base portions, said apparatus comprising first clamp means for detachably engaging at least one of said raised portions, said clamp means including a body with a cavity and means for frictionally engaging an external surface of said raised portion, said means for frictionally engaging comprising at least one blunt-nose screw having a generally convexly-shaped nose threadably interconnected to said body, said screw being extendable into said cavity to deform said external surface of said raised portion.

2. The apparatus of claim 1, further comprising second clamp means for detachably engaging a second of said raised portions, said second clamp means including a body with a cavity and means for frictionally engaging an external surface of said second raised portion, said means for frictionally engaging comprising at least one blunt-nose screw having a generally convexly-shaped nose threadably interconnected to said body, said screw being extendable into said cavity to deform said external surface of said second raised portion.

3. The apparatus of claim 1, wherein said screw is adapted to engage the external surface of said raised portion and does not penetrate through said external surface into an internal portion of said raised portion.

4. The apparatus of claim 2, wherein said screw of the second clamp is adapted to engage the external surface of said second raised portion and does not penetrate through said external surface into an internal portion of said second raised portion.

5. The apparatus of claim 2, further comprising a member attached to said first clamp means and said second clamp means.

6. The apparatus of claim 5, wherein said member is selected from the group consisting of building components, bolts, snow retention devices, frames and signs.

7. The apparatus of claim 1, wherein said means for frictionally engaging an external surface comprises at least two blunt-nose screws having a generally convexly-shaped nose threadably interconnected to said body, said screws being extendable into said cavity to deform said external surface of said raised portion.

8. The apparatus of claim 1, wherein said cavity has first and second sides, and said means for frictionally engaging an external surface comprises at least three blunt-nose screws having a generally convexly-shaped nose threadably interconnected to said body, wherein at least two of said screws are extendable into said cavity to engage said external surface of said raised portion from said first side of said cavity, and wherein at least one of said screws is extendable into said cavity to engage said external surface of said raised portion from said second side of said cavity.

9. A method for mounting a member on a roof with a plurality of clamps, the roof being formed from a substructure having raised portions laterally separated by base portions, wherein said raised portions are positioned a greater distance above a reference plane than said base portions, said method comprising the steps of:

(a) positioning first clamp means for detachably engaging a first raised portion at a point along said first raised portion, said first clamp means including a body with a slot and means for frictionally engaging an external surface of said first raised portion, said means for frictionally engaging comprising at least one blunt-nose screw threadably interconnected to said body, said screw being extendable into said slot to deform said external surface of said first raised portion;

(b) positioning second clamp means for detachably engaging a second raised portion at a point along said second raised portion, said second clamp means including a body with a slot and means for frictionally engaging an external surface of said second raised portion, said means for frictionally engaging comprising at least one blunt-nose screw threadably interconnected to said body, said screw being extendable into said slot to deform said external surface of said second raised portion; and (c) securing a member to said first and second clamp means.

10. The method as claimed in claim 9, wherein said screw of the first clamp means only engages said external surface of said first raised portion.

11. The method as claimed in claim 9, wherein said screw of the second clamp means comprises a generally convexly-shaped nose.

12. The method as claimed in claim 9, wherein said member is selected from the group consisting of building components, bolts, snow retention devices, frames and signs.

13. The method as claimed in claim 9, further comprising the step of repositioning at least one of said first clamp means and said second clamp means by loosening said screw of the clamp means to be repositioned, repositioning said clamp means and tightening said screw.

14. The method of claim 9, wherein said slot of said first and second clamp means has first and second sides, and said means for frictionally engaging an external surface of said first and second raised portions comprise at least three blunt-nose screws having a generally convexly-shaped nose threadably interconnected to said body, wherein at least two of said screws are extendable into said cavity to engage said external surface of said raised portion from said first side of said cavity, and wherein at least one of said screws is extendable into said cavity to engage said external surface of said raised portion from said second side of said cavity.

15. A method for mounting a clamp on a roof structure having raised portions laterally separated by base portions, wherein said raised portions are positioned a greater distance above a reference plane than said base portions, said method comprising the step of positioning first clamp means for detachably engaging a first raised portion at a point along said first raised portion, said first clamp means including a body with a slot and means for frictionally engaging an external surface of said first raised portion, said means for frictionally engaging comprising at least one blunt-nose screw threadably interconnected to said body, said screw being extendable into said slot to deform said external surface of said first raised portion.

16. The method as claimed in claim 15, wherein said screw only engages said external surface of said first raised portion.

17. The method as claimed in claim 15, wherein said screw comprises a generally convexly-shaped nose.

18. The method as claimed in claim 15, further comprising the step of repositioning said clamp by loosening said screw, repositioning said clamp, and tightening said screw.

19. The method of claim 15, wherein said slot of said first clamp means has first and second sides, and said means for frictionally engaging an external surface of said first raised portion comprises at least three blunt-nose screws threadably interconnected to said body, wherein at least two of said screws are extendable into said cavity to engage said external surface of said raised portion from said first side of said cavity, and wherein at least one of said screws is extendable into said cavity to engage said external surface of said raised portion from said second side of said cavity.

20. A mounting device attachable to a raised portion on a building surface, said mounting device comprising:

(a) a unitary mounting body comprising first and second generally longitudinally extending and laterally displaced side surfaces, generally longitudinally extending and vertically displaced upper and lower surfaces, and longitudinally displaced first and second ends, wherein said upper surface is substantially planar;

(b) a slot integrally formed in said mounting body and defining a portion of said lower surface, said slot defining a portion of each of said first and second ends and extending between said first and second ends, said slot comprising first and second sidewalls and being adapted for receiving at least an upper part of said raised portion, said upper surface of said unitary mounting body being disposed above said slot;

(c) a first mounting cavity on said substantially planar upper surface of said mounting body; and (d) a securing assembly comprising a first hole extending from one of said side surfaces through said mounting body to interface with said slot and a first member positionable within said first hole and being extendable within said slot to secure at least said upper part of said raised portion within said slot by engaging said upper part of said raised portion within said slot with said first member.

21. The device of claim 20, wherein said first member is a blunt-nose screw.

22. The device of claim 21, wherein said blunt-nose screw comprises a generally convexly-shaped nose.

23. The device of claim 20, wherein said first member is adapted to engage the external surface of said upper part of said raised portion and does not penetrate through said external surface into an internal portion of said raised portion.

24. The mounting device of claim 20, wherein said securing assembly comprises at least a first hole and a second hole extending from a first of said side surfaces through said mounting body to interface with said slot and a first member and a second member positionable within said first hole and said second hole respectively, wherein said securing assembly further comprises at least a third hole extending from a second of said side surfaces through said mounting body to interface with said slot and a third member positionable within said third hole, and wherein said first, second and third members are extendable within said slot to secure at least said upper part of said raised portion within said slot by engaging said upper part of said raised portion within said slot with said first, second and third members.

25. An apparatus attachable to a building roof or wall surface, said surface including a plurality of spaced, longitudinal raised portions, said raised portions extending from an elevated portion of said surface to a lower portion thereof and each being laterally separated by a base portion, wherein said raised portions are positioned a greater distance above a reference plane than said base portions, said apparatus comprising first clamp means for detachably engaging at least one of said raised portions, said clamp means including a body with cavities and means for frictionally engaging an external surface of said raised portion, said means for frictionally engaging comprising at least two screws disposed on one side of said first clamp means, said screws being extendable into said cavities to deform said external surface of said raised portion.

26. The apparatus of claim 25, further comprising second clamp means for detachably engaging a second of said raised portions, said second clamp means including a body with a cavity and means for frictionally engaging an external surface of said second raised portion, said means for frictionally engaging comprising at least two screws disposed on one side of said second clamp means, said screws being extendable into said cavity to deform said external surface of said second raised portion.

27. The apparatus of claim 25, wherein said screws are adapted to engage the external surface of said raised portion and do not penetrate through said external surface into an internal portion of said raised portion.

28. The apparatus of claim 26, wherein said screws of the second clamp means are adapted to engage the external surface of said second raised portion and do not penetrate through said external surface into an internal portion of said second raised portion.

29. The apparatus of claim 26, further comprising a member attached to said first clamp means and said second clamp means.

30. The apparatus of claim 29, wherein said member is selected from the group consisting of building components, bolts, snow retention devices, frames and signs.

31. The apparatus of claim 25, wherein said means for frictionally engaging further comprise at least one screw disposed on a second side of said clamp means.

32. A method for mounting a member on a roof with a plurality of clamps, the roof being formed from a substructure having raised portions laterally separated by base portions, wherein said raised portions are positioned a greater distance above a reference plane than said base portions, said method comprising the steps of:

(a) positioning first clamp means for detachably engaging a first raised portion at a point along said first raised portion, said first clamp means including a body with a slot and means for frictionally engaging an external surface of said first raised portion, said means for frictionally engaging comprising at least two screws disposed on one side of said first clamp means, said screws being extendable into said slot to engage said external surface of said first raised portion;

(b) positioning second clamp means for detachably engaging a second raised portion at a point along said second raised portion, said second clamp means including a body with a slot and means for frictionally engaging an external surface of said second raised portion, said means for frictionally engaging comprising at least two screws disposed on one side of said second clamp means, said screws being extendable into said slot to engage said external surface of said second raised portion; and (c) securing a member to said first and second clamp means.

33. The method as claimed in claim 32, wherein said screws only engage said external surface of said first raised portion.

34. The method as claimed in claim 32, wherein said screws each comprise generally convexly-shaped noses.

35. The method as claimed in claim 32, wherein said member is selected from the group consisting of building components, bolts, snow retention devices, frames and signs.

36. The method as claimed in claim 32, further comprising the step of repositioning at least one of said first clamp means and said second clamp means by loosening said screws of the clamp means to be repositioned, repositioning said clamp means and tightening said screws.

37. The method of claim 32, wherein said means for frictionally engaging of said first clamp means further comprises at least one screw disposed on a second side of said first clamp means, and wherein said means for frictionally engaging of said second clamp means further comprises at least one screw disposed on a second side of said first clamp means.

38. A method for mounting a clamp on a roof structure having raised portions laterally separated by base portions, wherein said raised portions are positioned a greater distance above a reference plane than said base portions, said method comprising the step of positioning first clamp means for detachably engaging a first raised portion, said first clamp means including a body with a slot and means for frictionally engaging an external surface of said first raised portion at a point along said first raised portion, said means for frictionally engaging comprising at least two screws disposed on one side of said slot, said screws being extendable into said slot to engage said external surface of said first raised portion.

39. The method as claimed in claim 38, wherein said screws only engage said external surface of said first raised portion.

40. The method as claimed in claim 38, wherein said screws comprise generally convexly-shaped noses.

41. The method as claimed in claim 38, further comprising the step of repositioning said clamp by loosening said screws, repositioning said clamp, and tightening said screws.

42. The method of claim 38, wherein said means for frictionally engaging of said first clamp means further comprises at least one screw disposed on a second side of said first clamp means, said screw being extendable into said slot.

43. A mounting device attachable to a raised portion on a building surface, said mounting device comprising:

(a) a unitary mounting body comprising first and second generally longitudinally extending and laterally displaced side surfaces, generally longitudinally extending and vertically displaced upper and lower surfaces, and longitudinally displaced first and second ends, wherein said upper surface is substantially planar;

(b) a slot integrally formed in said mounting body and defining a portion of said lower surface, said slot defining a portion of each of said first and second ends and extending between said first and second ends, said slot comprising first and second sidewalls and being adapted for receiving at least a part of said raised portion, said upper surface of said unitary mounting body being disposed above said slot;

(c) a first mounting cavity on said substantially planar upper surface of said mounting body; and (d) a securing assembly comprising at least a first hole extending from one of said side surfaces through said mounting body to interface with said slot and first and second members positionable within said first and second holes and being extendable within said slot to secure at least said part of said raised portion within said slot by engaging said part of said raised portion within said slot with said first and second members.

44. The device of claim 43, wherein said first and second members are blunt-nose screws.

45. The device of claim 44, wherein said blunt-nose screws comprise generally convexly-shaped noses.

46. The device of claim 43, wherein said first and second members are adapted to engage an external surface of said part of said raised portion and do not penetrate through said external surface into an internal portion of said raised portion.

47. The device of claim 43, wherein said securing assembly further comprises at least one additional hole extending from a second of said side surfaces through said mounting body to interface with said slot and at least one additional member positionable within said additional hole and being extendable within said slot to secure at least said part of said raised portion within said slot.

48. A mounting device attachable to a raised portion on a building surface, said mounting device comprising:

(a) a unitary mounting body comprising first and second generally longitudinally extending and laterally displaced side surfaces, generally longitudinally extending and vertically displaced upper and lower surfaces, and longitudinally displaced first and second ends;

(b) a slot integrally formed in said mounting body and defining a portion of said lower surface, said slot defining a portion of each of said first and second ends and extending between said first and second ends, said slot comprising first and second sidewalls and being adapted for receiving at least a part of said raised portion, said second sidewall being substantially planar, said upper surface of said unitary mounting body being disposed above said slot;

(c) at least a first mounting cavity on said mounting body; and (d) a securing assembly comprising at least a first hole extending from said first sidewall through said mounting body to interface with said slot and a first member positionable within said hole and being extendable within said slot to secure at least said part of said raised portion within said slot by engaging said part of said raised portion within said slot with said first member.

49. The device of claim 48, wherein said first member is a blunt-nose screw.

50. The device of claim 49, wherein said blunt-nose screw comprises a generally convexly-shaped nose.

51. The device of claim 48, wherein said first member is adapted to engage an external surface of said part of said raised portion and does not penetrate through said external surface into an internal portion of said raised portion.

52. The device of claim 48, wherein a cavity is formed in the second sidewall of the slot opposite said first member of said securing assembly.

53. The device of claim 48, wherein said hole and mounting member are not confined to a single sidewall.

54. The device of claim 48, wherein said securing assembly further comprises at least a second hole member extending from said wall and a second member positionable within said second hole and at least one hole extending from said second sidewall through said mounting body to interface with said slot and a member positionable in said hole.

* * * * *